US005512924A

United States Patent [19]

Takada et al.

[11] Patent Number: 5,512,924

[45] Date of Patent: Apr. 30, 1996

[54] JET APPARATUS HAVING AN INK JET HEAD AND TEMPERATURE CONTROLLER FOR THAT HEAD

[75] Inventors: Yoshihiro Takada; Akio Suzuki, both of Yokohama; Masami Izumizaki; Ken Tsuchii, both of Tokyo; Hidejiro Kadowaki, Yokohama; Toshiyuki Yanaka, Tokyo; Haruhiko Takahashi, Yokohama; Makoto Takamiya, Kawasaki; Kosuke Yamamoto, Yokohama; Masafumi Wataya; Yasushi Miura, both of Kawasaki; Haruhiko Moriguchi, Yokohama; Yasushi Murayama, Tokyo, all of Japan

[73] Assignee: Canon Kabushiki Kaisha, Tokyo, Japan

[21] Appl. No.: 190,220

[22] Filed: Feb. 1, 1994

Related U.S. Application Data

[63] Continuation of Ser. No. 852,333, Mar. 17, 1992, abandoned, which is a continuation of Ser. No. 458,569, Dec. 28, 1989, abandoned.

[30] Foreign Application Priority Data

| | | | |
|---|---|---|---|
| Dec. 28, 1988 | [JP] | Japan | 63-329478 |
| Mar. 9, 1989 | [JP] | Japan | 1-55201 |
| Mar. 9, 1989 | [JP] | Japan | 1-55202 |
| Mar. 9, 1989 | [JP] | Japan | 1-55203 |
| Mar. 9, 1989 | [JP] | Japan | 1-55204 |
| Mar. 10, 1989 | [JP] | Japan | 1-56247 |
| Sep. 1, 1989 | [JP] | Japan | 1-224654 |
| Dec. 22, 1989 | [JP] | Japan | 1-333159 |

[51] Int. Cl.[6] ..... B41J 2/05; B41J 29/377

[52] U.S. Cl. ..... 347/18; 347/42

[58] Field of Search ..... 347/18, 67, 223, 347/42

[56] References Cited

U.S. PATENT DOCUMENTS

| | | | |
|---|---|---|---|
| 4,296,421 | 10/1981 | Hara | 347/18 |
| 4,313,124 | 1/1982 | Hara . | |

(List continued on next page.)

FOREIGN PATENT DOCUMENTS

| | | |
|---|---|---|
| 50-4912 | 1/1975 | Japan . |
| 53-42619 | 11/1978 | Japan . |
| 55-5429 | 2/1980 | Japan . |
| 55-6509 | 2/1980 | Japan . |
| 56-9429 | 3/1981 | Japan . |
| 59-123670 | 7/1984 | Japan . |
| 59-138461 | 8/1984 | Japan . |
| 62-55990 | 11/1987 | Japan . |

*Primary Examiner*—Joseph W. Hartary

*Attorney, Agent, or Firm*—Fitzpatrick, Cella, Harper & Scinto

[57] ABSTRACT

An ink jet apparatus has an ink jet head with a heat generating resistance element, which head discharges ink droplets by causing a state change in ink using heat generated by the resistance element, conveying means for conveying a recording medium to be recorded upon in a conveyance direction so that a predetermined recording image is formed on the recording medium by ink droplets from the head, heat exchanging means for exchanging heat with the head, this exchanging means being attached to the side of the head where the element is provided, and heating means for heating the exchanging means, the heating means being part of the heat exchanging means. It also includes a cooling means for cooling the heat exchanging means, temperature detecting means for detecting the temperature of the heat exchanging means, and control means for controlling driving of the heating means and cooling means according to the temperature detected by the temperature detecting means. The head to which the heat exchanging means is attached is joined to the apparatus so that the heat exchanging means is positioned at a downstream side in the conveyance direction of the recording medium.

7 Claims, 19 Drawing Sheets

U.S. PATENT DOCUMENTS 4,345,262 8/1982 Shirato et al. .
4,442,459 4/1984 Fukui ..... 347/18 X
4,459,600 7/1984 Sato et al. .
4,463,359 7/1988 Ayata et al. .
4,558,333 12/1985 Sugitani et al. .
4,704,620 11/1987 Ichihashi ..... 347/18
4,723,129 2/1988 Endo et al. .
4,740,796 4/1988 Endo et al. .
4,763,992 8/1988 Takada et al. .
4,819,011 4/1989 Yokota ..... 347/223
4,829,323 5/1989 Suzuki et al. .
4,831,390 5/1989 Deshpande et al. ..... 347/18

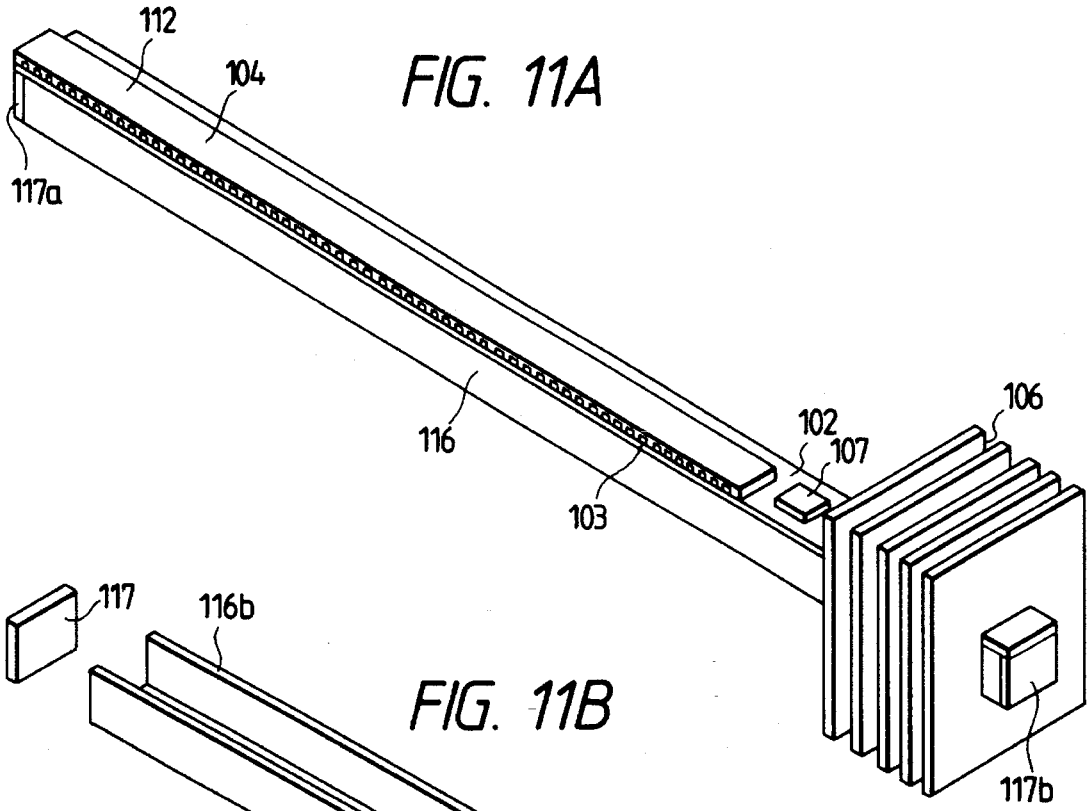
FIG. 11A
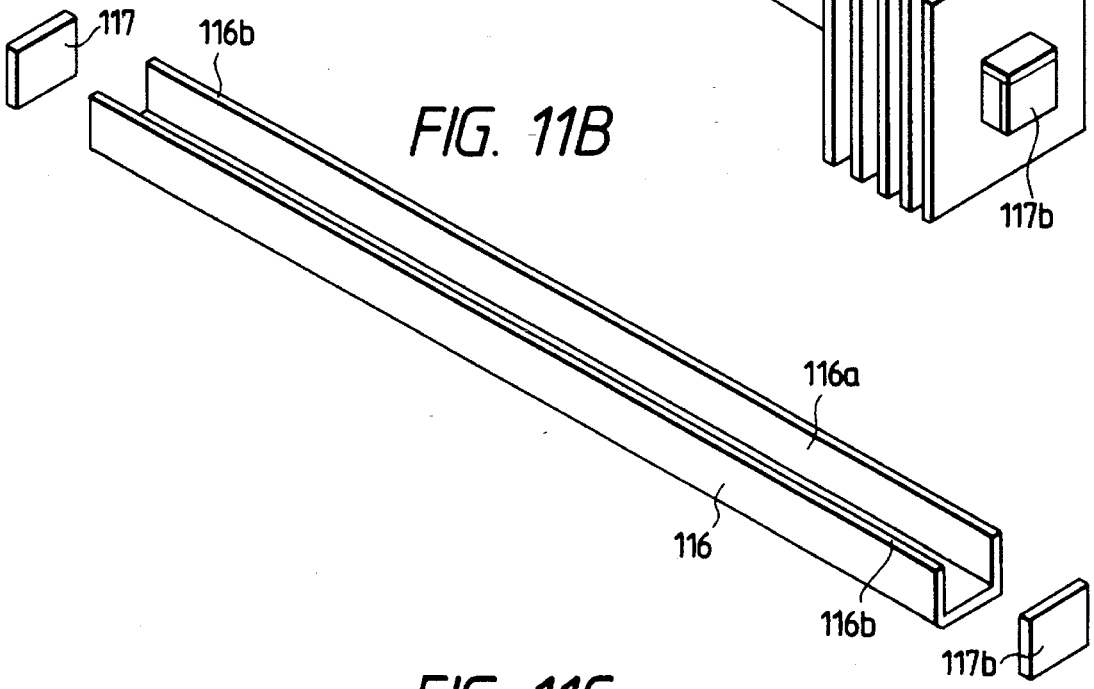
FIG. 11B
FIG. 11C
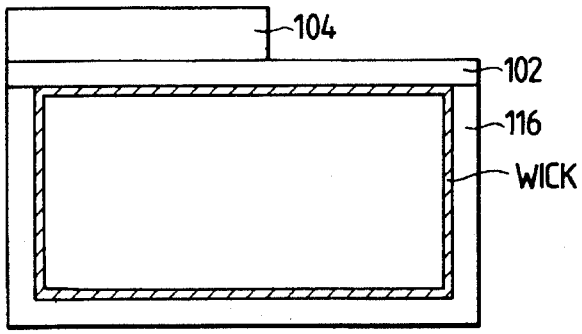

JET APPARATUS HAVING AN INK JET HEAD AND TEMPERATURE CONTROLLER FOR THAT HEAD

This application is a continuation of application Ser. No. 07/852,333, filed Mar. 17, 1992, which was a continuation of application Ser. No. 07/458,569, filed Dec. 28, 1989, both now abandoned.

BACKGROUND OF THE INVENTION

1. Field of the Invention

The present invention relates to a recording apparatus for recording images by utilizing thermal energy, a recording head unit mounted on the recording apparatus, and a temperature controller for use in the recording head.

In particular, it relates to a recording apparatus provided with a heat generating resistive element for generating thermal energy and carrying out image formation by discharging the ink droplet by usage of heat generation of the element, a recording head unit provided with the above recording apparatus, and temperature controlling apparatus used for the above head unit.

2. Related Background Art

As one of recording systems for producing images on a material on which the images are to be recorded, there is known an ink jet recording system in which ink is discharged in the form of droplets for recording.

Recording heads combined with such an ink jet recording system have widely been employed in recording output units for computers, word processors and the like because of lower operating noise, a simple basic mechanical structure, and lower cost than other recording systems.

Generally, a recording head in the ink jet recording system includes discharge energy generator means which are each disposed at a discharge port or orifice (opening) for discharging ink in the form of droplets, or at a part of a liquid passage or liquid chamber communicating with the discharge port, thereby imparting discharge energy sufficient to discharge a part of ink within the liquid passage to form a flying droplet.

Known discharge energy generator means include, for example, mechanical energy generator means such as electro-mechanical transducers represented by piezoelectric elements, electromagnetic energy generator means for irradiating electromagnetic waves such as lasers to ink that absorbs the irradiated energy to form flying droplets, and thermal energy generator means such as electro-thermal transducers.

Those ink jet recording heads which employ thermal energy generator means such as electro-thermal transducers, in particular, among the above energy generator means, can be manufactured relatively simply by making use of the microprocessing technology which has recently gained remarkable progress in the field of semiconductors. Thus, the microprocessing technology makes it possible to easily manufacture recording heads in long sizes or in a planar or two-dimensional form, so that discharge ports can be formed in the multi-orifice arrangement with higher density.

As a result, it has become easy to produce recording with higher resolution and fabricate recording heads in compact sizes.

FIG. 1 is a schematic perspective view showing one example of an ink jet recording head in which 10 electro-thermal transducers are used as the thermal energy generator means. As seen from FIG. 1, a recording head 2 mainly comprises electro-thermal transducers 51, electrodes 52, liquid passage walls 53 and a top plate 54. The recording head is formed on a silicon substrate 50 through semiconductor manufacture processes such as etching, vaporing or sputtering. Ink 13 is supplied from an ink reservoir (not shown) through an ink supply tube 55 to a common liquid chamber 56 of the recording head 2. Denoted by 57 is a connector for the ink supply tube 55, and 60 is an ink supply port.

The ink 13 is supplied by a capillary phenomenon from the ink reservoir to the common liquid chamber 56 and then to respective liquid passages 10 for forming a meniscus at each ink discharge port 59, defined at the distal end of the liquid passage 10, in a stable state. When the electro-thermal transducer 51 is energized to generate heat, this abrupt heating causes the ink 13 to develop a film boiling phenomenon to produce vapor bubbles in the ink 13. Dependent on expansion and contraction of the produced bubbles, the ink is discharged from the ink discharge ports 39 to form flying droplets.

With the above arrangement of the recording head, not only ink jet recording heads of the multi-nozzle type having 128 or 256 nozzles, but also longer recording heads for full-line printers with nozzles in numbers ranging from one thousand and several hundreds to several thousands can easily be manufactured with high productivity through achievement of nozzle arrangements of high nozzle density, e.g., 16 nozzles/mm.

In those ink jet recording heads using the thermal energy generator means such as electro-thermal transducers, however, since ink is discharged under the generation of heat by the electro-thermal transducers, the temperature of the discharged ink is raised with repeated cycles of heating during the recording process. As a result, the formed droplets might be affected adversely to degrade the recording quality of images.

The above technical problem will be described below in more detail. Assuming that the voltage and current applied to the electro-thermal transducers are held constant, changes in temperature of a recording head is related to the amount of ink per dot discharged from the recording head such that as the temperature of the discharged ink rises, viscosity of ink is reduced and an amount of ink per dot is increased.

Dependent on changes in the temperature of the discharged ink, therefore, dots deposited on the surface of recording paper to form an image become different in the size and eventually the intended recording image density or tone cannot be obtained.

In an ink jet recording apparatus comprising a plurality of recording heads, the temperatures of the discharged ink may be different from one another with the lapse of recording time due to a difference in the frequency of use between the respective heads. Thus, supposing the diameter of recording dot to be $D_0$ at the record lapse time of zero under a certain temperature of the recording heads, for example, one recording head has a temperature $T_A$ (° C.) and the other recording head has a temperature $T_B$ (° C.) at the record lapse time of t, whereby the recording heads respectively produce the diameters $D_A$, $D_B$ of recording dots different from each other. This results in a problem to be solved that an image recorded by the plurality of recording heads is out of density balance in the monochromatic case, or out of color balance when the recording heads respectively discharge ink of different colors.

Meanwhile, when the recording apparatus has not been used for a long period of time, the entire apparatus including the head and the ink supply system becomes substantially equal to an environmental temperature of the surroundings.

In such a case, if the environmental temperature is low, the ink temperature is also reduced and hence viscosity of ink is increased to prevent the recording apparatus from quickly starting operation at the time of start-up. As a result, the recording apparatus might require a long period of time until desired recording is achieved, with the result that it can not be driven immediately after turning it on.

Thus, in the recording apparatus that employs ink, changes in the ink temperature vary viscosity of the ink or produce dissolved gas in the ink. Stated otherwise, ink discharge characteristics are largely affected by not only the ink temperature but also the temperature in the vicinity of a recording head surrounding the ink.

As described above, the discharged state of ink is greatly dependent on such factors as viscosity of the ink in the discharge port or orifice, the generation process and maximum volume of bubbles caused by a phase change of the ink upon thermal energy being applied thereto. Then, changes in viscosity of the ink is dependent on a length of time in which recording has not been made, and the ink temperature. The generation process and maximum volume of bubbles are also mainly dependent on the ink temperature. Accordingly, control of the ink temperature is a basic factor for maintaining the performance of ink jet recording. The following has therefore been proposed in the past as means to stabilize ink characteristics.

First, Japanese Patent Publication No. 53-42619, No. 55-5429 and the like disclose an arrangement that an ink supply passage is associated at its part with an ink warming device, and ink is always warmed to keep the ink temperature constant. Secondly, Japanese Patent Laid-Open No. 50-4912 discloses an arrangement that a head is provided on its rear surface with a heat conducting member and a heater to warm an ink supply passage for keeping the ink temperature constant.

Thirdly, Japanese Patent Publication No. 55-6509 discloses an arrangement that a member of high thermal conductivity is brought into contact with a print head, which has been overheated, as required to accelerate heat radiation from the print head.

Fourthly, Japanese Patent Publication No. 56-9429 discloses an arrangement that a head housing is surrounded by a group of Peltier effect elements for purpose of quickly cooling the housing to reduce a pressure in an ink chamber.

With the first arrangement, however, although the temperature of ink flowing into the respective discharge ports can be held in certain range, the ink temperature becomes different between those discharge ports which are used for recording with higher frequency and those discharge ports which are used for recording with lower frequency. This makes it difficult to provide the uniform discharge performance throughout the head. With the second arrangement, since the ink flowing into the respective discharge ports is warmed regardless of frequency of use thereof, there still remains the similar problem as that in the above case.

With the third arrangement, the ink is prevented from being overheated. But, the above problem still remains in this case, too, because heat is radiated without considering frequency of use of the respective discharge ports and the temperature environment is differently developed for each of the discharge ports. With the fourth arrangement, the head housing is cooled to reduce a pressure in the ink chamber for purpose of preventing the ink from dripping from the discharge ports. However, since the temperature adjustment in this case is not carried out taking into account the fact that the discharge characteristics are dependent on viscosity of the ink, an improvement in recording characteristics has not resulted.

In the foregoing proposed arrangements, notwithstanding a single recording head contains an area where ink is discharged more frequently and an area where ink is discharged less frequently, the recording head is controlled to warm the whole of ink by applying a uniform amount of heat thereto, or to remove a uniform amount of heat from the entire head. As explained above, therefore, viscosity of the ink might be varied due to variations in the ink temperature between the respective discharge ports to render the discharged state of ink different therebetween, whereby the proper recording could not be ensured.

Particularly, in the case where recording paper of large width is used and a recording head itself is increased in its length, or where ink is discharged from the discharge orifices unevenly dependent on the content of recording, there still remains a problem that heat flux density in a recording head largely differs between head areas, and the temperature distribution is made not uniform in the single head.

In other words, with the recording head being increased in its length, it might be more difficult to heat or cool for holding the entire recording head at a uniform temperature, thereby causing temperature variations in the direction of length of the recording head.

SUMMARY OF THE INVENTION

As an ink jet recording apparatus using a heat pipe from different viewpoint, there is shown the recording apparatus disclosed in Japanese Patent Publication No. 62-55990. This publication discloses the construction in which heat generated at the full-line type recording head is supplied to the recorded medium, and the heat pipe is attached to the recording head to dry the recording ink. That invention is based on concept of utilizing retained heat of the recording head, and accordingly different from the present invention.

In detail, the above heat pipe has laid V-2-shaped configuration, and can collect retained heat over the whole area of the recording head in contact therewith. However, this prior art is related to reuse of heat relative to the recorded image, but is not related to the recording head itself under printing process.

In any event, the present invention is related to new subject matter and has an object to provide a recording apparatus capable of recording in high speed and forming high accuracy image.

An object of the present invention is to provide a recording apparatus, a recording head unit mounted on the recording apparatus, and a temperature controller for use in the recording head, in and by which an entire recording head can be adjusted to a uniform temperature during the recording regardless of an area that contributes to discharge of ink more frequently and an area that contributes to discharge of ink less frequently, or in and by which the head temperature (ink temperature) can be adjusted to a desired temperature at start-up of the recording, whereby viscosity of ink is kept even at respective discharge ports and hence the discharged state of ink becomes not uniform between the discharge ports.

Another object of the present invention is to provide a recording apparatus having a recording head for discharging ink by the utilization of heat to thereby form an image on a recording medium; heat exchange means having a first heat exchange portion for contacting with one side of said recording head to effect heat exchange and a second heat exchange portion positioned in the outside separate from said recording head; heating means provided in said heat exchange means for heating said heat exchange means; cooling means for acting on said second heat exchange portion of said heat exchange means and assisting radiation of heat in said second heat exchange portion; temperature detecting means; and drive controlling means for controlling the driving of said heating means-and/or said cooling means on the basis of the value of the temperature detected by said temperature detecting means.

Another object is to provide a recording head unit having a recording head for discharging ink by the utilization of heat to thereby form an image on a recording medium; heat exchange means having a first heat exchange portion for contacting with one side of said recording head to effect heat exchange and a second heat exchange portion positioned in the outside separate from said recording head; heating means provided in said heat exchange means for heating said heat exchange means; and cooling means for acting on said second heat exchange portion of said heat exchange means and assisting radiation of heat in said second heat exchange portion.

Still another object is to provide a temperature control device for contacting with a recording head for discharging ink by the utilization of heat to thereby form an image on a recording medium, and controlling the temperature of said recording head, having heat exchange means contacting with said recording head relative to the direction of arrangement of heat generating resistance elements generating the heat utilized for the image formation by said recording head to effect heat exchange and capable of transferring heat energy; and temperature control means for said heat exchange means for effecting the control of the temperature of said heat exchange means, said temperature control means having heating means for heating said heat exchange means and cooling means for cooling said heat exchange means.

BRIEF DESCRIPTION OF THE DRAWINGS

FIGS. 11A through 11D are perspective views showing still another arrangement example of a recording head unit;

DETAILED DESCRIPTION OF THE PREFERRED EMBODIMENTS

Hereinafter, embodiments in which the present invention is employed will be described with reference to the drawings.

Figure 2:
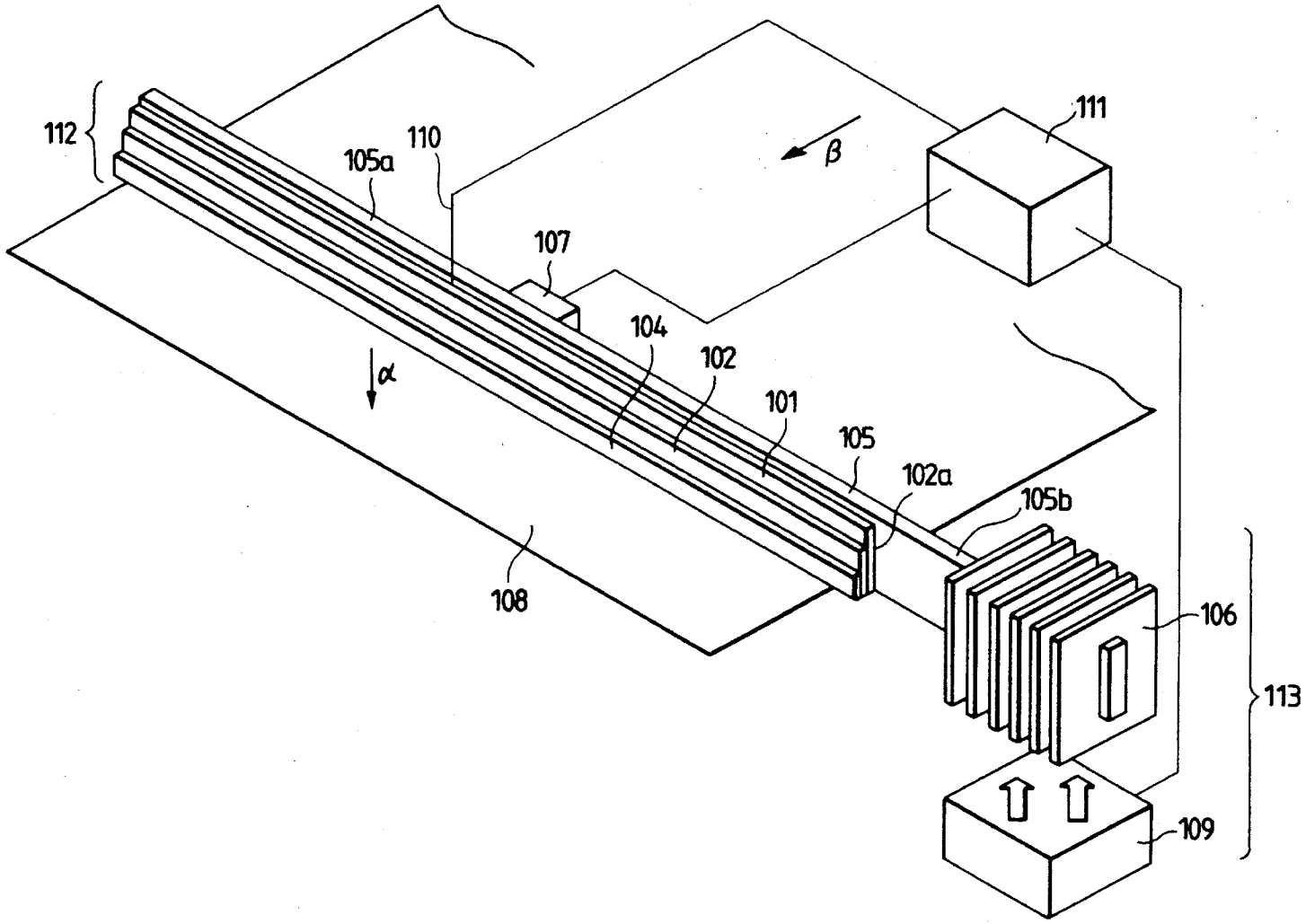
FIG. 2 is a perspective view for showing one example of a recording head unit mounted on a recording apparatus in which the present invention is employed.

FIG. 2 is a perspective view showing a recording apparatus according to one embodiment of the present invention. This embodiment will be explained in connection with a recording head of the so-called full-line type in which discharge ports are formed over an entire recording width of a material on which images are to be recorded.

In FIG. 2, designated by reference numeral 102 is a base member on which at least one element for applying thermal energy to ink (i.e., a heating portion in the bubble jet type apparatus) is provided corresponding to each discharge port or orifice (these elements being not shown in the figure). The discharge ports are arranged plural in number side by side in the direction of length of the recording head, and discharge ink therethrough when thermal energy is applied to ink from the aforesaid element. 104 is a top plate which defines the discharge ports and a common liquid chamber (not shown) for supplying ink to the discharge ports therethrough, when joined to the base member 102. Ink is appropriately supplied to the top plate 104 from an ink reservoir (not shown). 101 is a support member partially bonded to the base member 102. The above-mentioned components jointly constitute a recording head 112.

As shown in FIG. 2, along substantially an entire region of one side face 102 of the recording head 112 in the direction of length thereon in which head a plurality of electro-thermal transducers used for discharging ink are arranged, there is disposed a heat pipe 105 as heat exchanger means which comprises a first heat exchanging portion 105*a* contacted with the above side face region, and a second heat exchanging portion 105*b* positioned remote from the recording head 112 on the outside thereof.

In particular, in the present embodiment, the heat pipe is connected to the recording head at side of the base member 102 where the electric-heat exchange element is formed. Such arrangement is desirable from viewpoints of excellence in heat pipe arrangement as well as ease of control for keeping temperature of the recording head constant.

Additionally, it is preferable to make the connecting surface of the heat pipe at which it is connected with the recording head flat. Considering this, a heat pipe of rectangular parallelepiped cross-section has been used in the present embodiment.

A heater 107 as heating means for heating the heat pipe 105 is disposed in a desired region, and a temperature sensor 110 as temperature detecting means of the contact type is disposed in a desired region of the heat pipe 105, while being held in contact therewith, for detecting a temperature of the heat pipe 105.

Cooling means 113 is provided to act on the second heat exchanging portion 105*b* of the heat pipe 105 for assisting radiation of heat from the second heat exchanging portion 105*b*.

Further, a controller 111 as drive control means is provided to control operation of the cooling means 113 and/or the heating means 107 based on a value of the detected temperature from the temperature sensor 110.

In this embodiment, the cooling means 113 comprises a plurality of heat radiating fins 106 provided in direct contact with the second heat exchanging portion 105*b* of the heat pipe 105, and a fan 109 for blowing air to improve the heat radiating ability of the fins 106, thereby to offer satisfactory heat radiating characteristics.

Especially, the fins 106 are provided above the fan 109 so that it generates the air-flow from underside of the fins 106 to upperside of the same. Heat naturally flowing upwardly is facilitated by the above air flow from underside to upperside. In addition, by arranging plural fins 106 in the direction to intersect with the heat pipe, it becomes possible so that influence by the air flow does not reflect on the recording area combining the air-flow direction due to the fan 109.

In this embodiment, the heater (heat generator) 107 for heating the heat pipe 105 is disposed at a position corresponding to substantially the center of the recording head 112 in the direction of length thereof, on the side face opposite to that on which the recording heat 112 is disposed.

It is noted that the location of the temperature sensor is not limited to the above mentioned position but can be disposed on the component of recording head directly or on the support base plate, or onto the heat pipe itself. In the case of mounting on the heat pipe itself, the temperature sensor can be mounted on the first heat exchange portion including the recording area, or the second heat exchange portion remote from the recording head.

In the case mounting at the boundary area between the recording head and the heat pipe, it is possible to detect the average temperature therebetween, which makes the temperature control of the recording head easy. Additionally, when providing it or a component of the recording head, it is desirable from the aspect that temperature of the head is detected directly. Furthermore, provision of the temperature sensor on the heat pipe itself enables to detect temperature of the member adjusting temperature of the recording head accurately, whereby temperature control of the recording head can be effected securely.

A recording head unit thus constituted by the heat pipe 105, the recording head 112, the heat radiating fins 106 and the heater (heat generator) 107, is arranged in the ink jet recording apparatus such that the direction of length of the unit is coincident with the direction of width of a material 108 on which an image is to be recorded, and the discharge ports are directed opposite to the surface of the recording material 108. The recording material 108 is fed by feeding means (not shown) in the direction of arrow $\beta$, while ink is discharged from the discharge ports 103 in the direction of arrow $\alpha$ in response to an image signal, thereby recording an image.

The controller 111 is connected to the temperature sensor 110 to receive a value of the detected temperature from the temperature sensor.

Based on the detected temperature, the controller 111 regulates electric power applied to the heater 107 and the fan 109, or an ON - OFF time interval thereof, for controlling operation of the heater 107 and the fan 109.

Figures 22A, 22B:
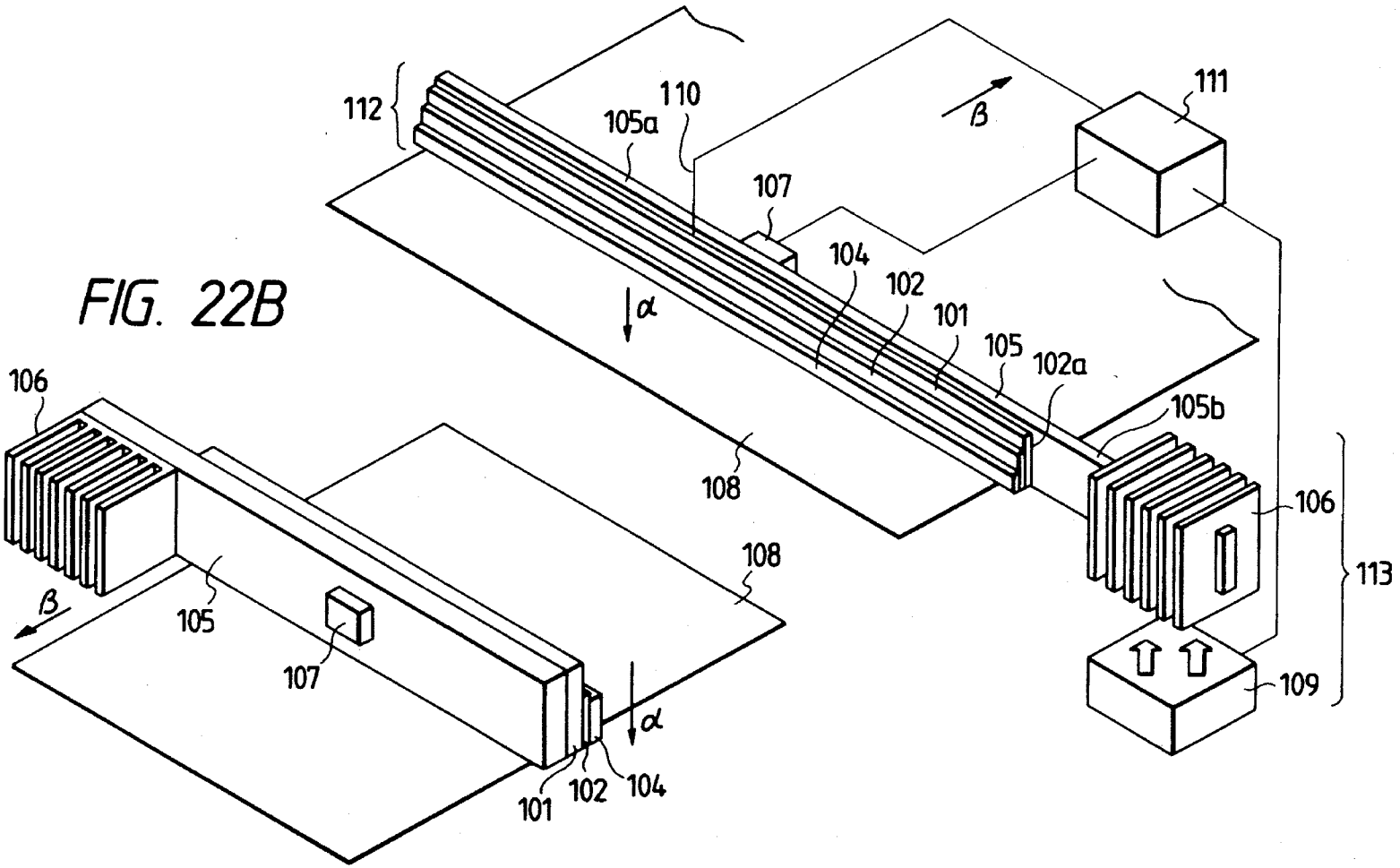
FIGS. 22A and 22B are perspective views showing mounting manner of the recording head unit.
Figure 23B:
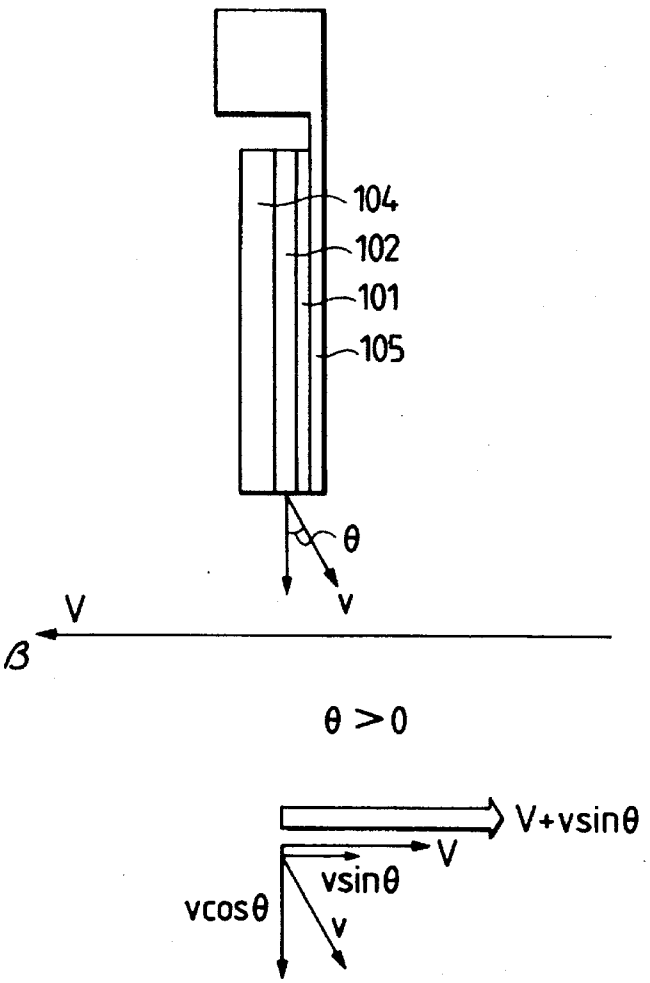
FIGS. 23A and 23B showing relation between conveyance direction of the material to be recorded and mounting position of heat exchange means.
Figure 23A:
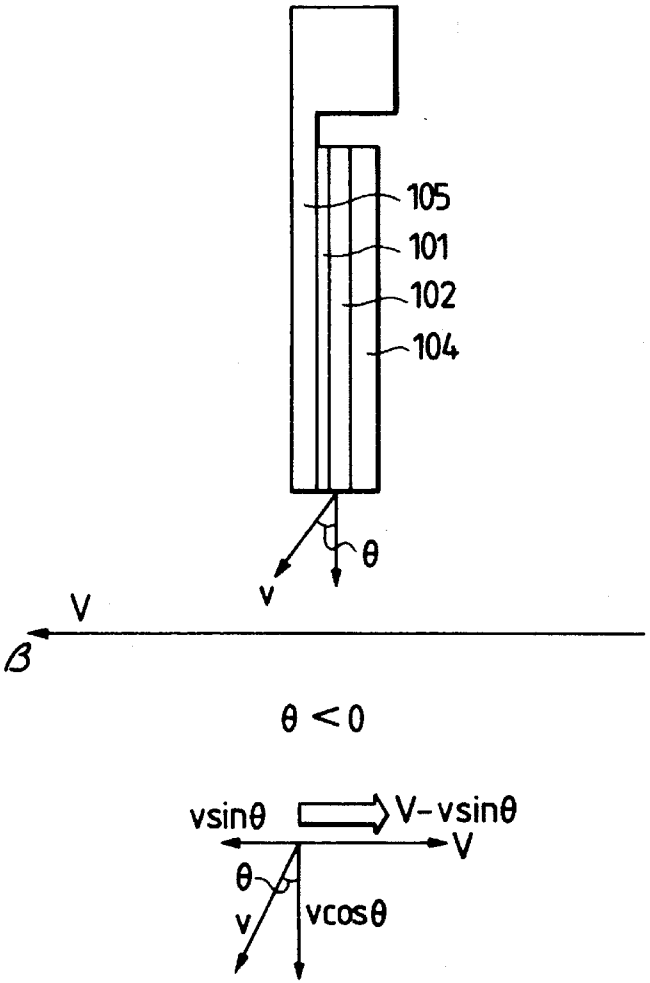

As shown in FIG. 2, the heat pipe is mounted onto the recording head so as to be located at upstream side in the conveying direction of the material to be recorded in the present embodiment. In addition, as shown in FIGS. 22A and 22B, the heat pipe can be mounted onto the recording head so as to be located at downstream side in the conveying direction of the material to be recorded. Such arrangement enables an increase in attaching accuracy of the ink droplet to the recording medium.

Reasons for them will be explained hereinafter.

FIG. 22A shows relation between a BJ full multi-type head 112 suitable for the present invention and conveying direction B of the recording sheet, in which a radiating fin 101 as temperature adjusting means is made of Al base plate, 102 shows a silicon base plate on which heater (not shown) for discharging the ink onto the silicon base plate is disposed for each of nozzles. 104 shows a glass ceiling plate for forming the nozzle. Attaching error due to twist of the sheet can be reduced by arranging the heat pipe 105 side downstream side in the conveying direction $\beta$ of the recording sheet.

The reason of the above decrease of attaching error of the ink droplet can be assumed below. Experiment reveals that the liquid droplet has tendency to be attracted toward the silicon base plate 102, the twist direction is determined in the silicon base plate 102 side (this phenomenon results from the difference of wetness property between the orifice surfaces of the silicon base plate and the glass base plate). It is effective to determine the sheet conveying direction in view of the twist direction of the sheet. For example, assuming that conveying speed of the recording sheet is selected V, discharge speed of the liquid droplet $v$, discharge angle of the same $\theta$, distance between the head and the sheet x, attaching position y (head position is selected as zero point) can be represented by formulation when gravity, air resistance are ignored.

$$y(\theta) = (v\sin\theta + V) \times \frac{x}{v\cos\theta}$$

Accordingly, shift amount from the attached position when there is no twist can be represented by formulation.

$$\begin{aligned} \Delta y &= y(\theta) - y(0) \\ &= \left( \frac{v\sin\theta + V}{\cos\theta} - V \right) \frac{x}{v} \end{aligned}$$

From the above formulation, it becomes apparent that $$\Delta y(\theta>0) > \Delta y(\theta<0)$$

Accordingly, by selecting the discharge angle θ smaller than zero (θ<0), that is, by directing the silicon surface 102 side in the downstream side in the recording sheet conveying direction, the shift of attaching position relative to twist can be reduced. Meanwhile, mounting the heat pipe 105 via the silicon base plate 102 and Al base plate 101 and carrying out heat control is effective from viewpoint of heat transmission. The above features can be adapted to the embodiment to be described hereinafter. It is preferable to select the mounting position of the heat pipe to the apparatus at the downstream side relative to conveying direction of the recording medium from viewpoint increasing the attaching accuracy of the ink droplet, although it can be selected at the upstream side.

There will now be described control for temperature adjustment.

When a switch for starting the recording operation is turned on, the temperature of the support member 101 is first detected by the temperature sensor 110. If the detected temperature is lower than a certain temperature (hereinafter referred to as a prescribed temperature) at which the recording head is to be kept during the recording operation, the controller 111 turns on the heater 107 for heating the support member 101. At this time, the side of the bonding surface between the heat pipe 105 and the support member 101 serves as a condensing portion where a working liquid in the heat pipe 105 is evenly spread and then condensed to uniformly radiate latent heat, so that the support member 101 is subjected to the uniform heat flux for being evenly increased in its temperature.

Figure 3:
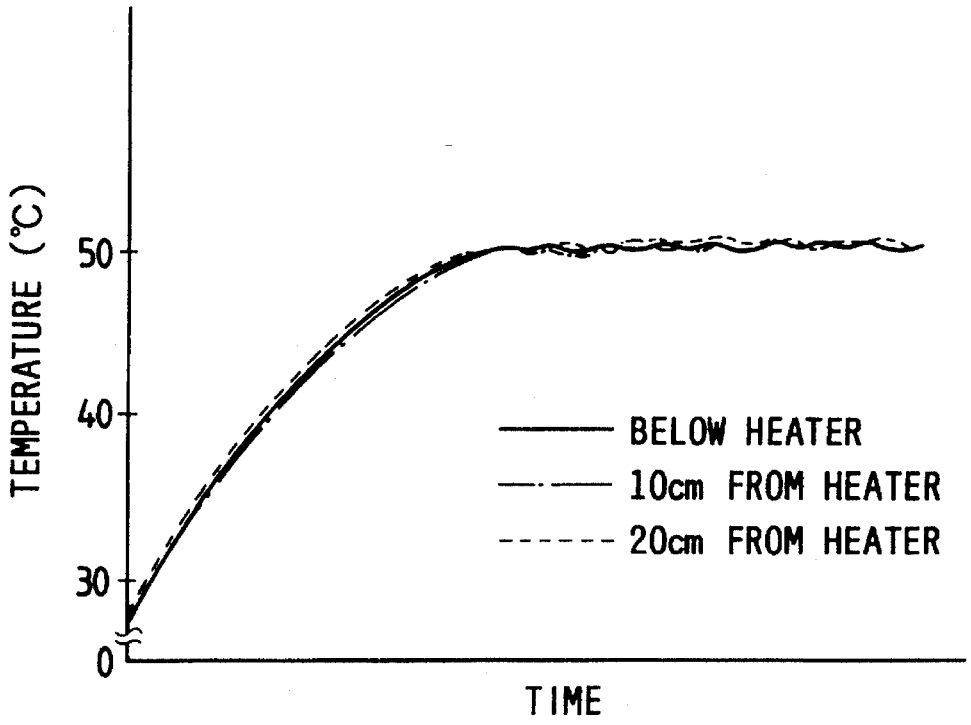
FIG. 3 is a characteristic graph showing temperature distribution in the direction of length of a recording head relative to the record lapse time when a heat pipe is used.
Figure 4:
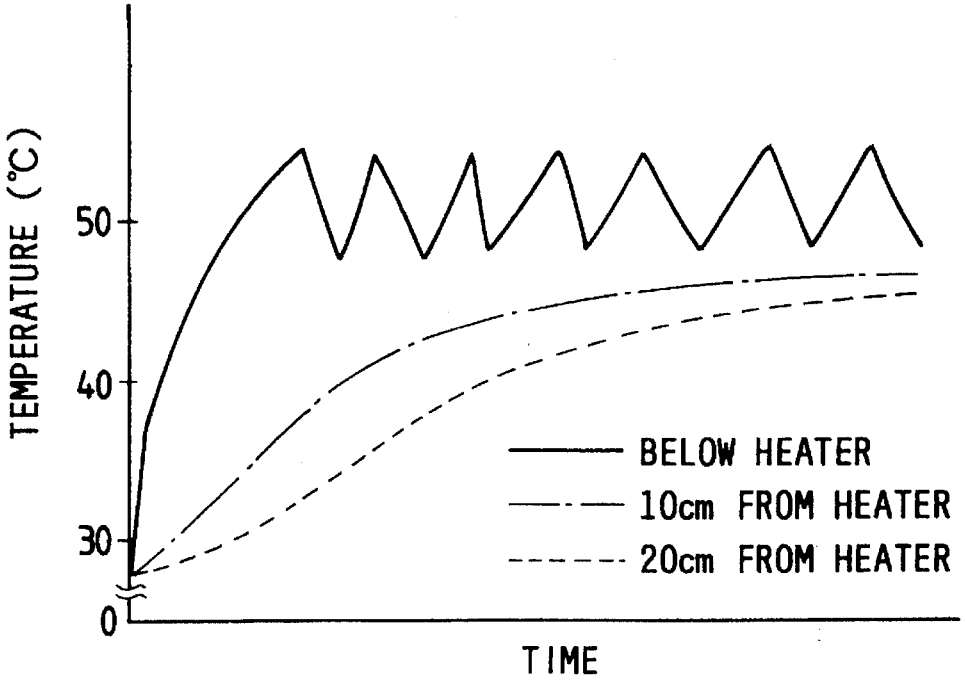
FIG. 4 is a characteristic graph showing temperature distribution in the direction of length of a recording head relative to the record lapse time when an Al plate is used.

FIG. 3 shows the actually measured data of time-dependent changes in temperature distribution in the direction of length of the support member 101 resulted from the above heating. FIG. 4 shows the actually measured data obtained when an aluminum plate of the same size as the heat pipe 105 is used in the same arrangement in place of the heat pipe 105. In FIGS. 3 and 4, the horizontal axis represents a time elapsed from turning-on of the heater 107, and the vertical axis represents a temperature at the contact surface between the support member 101 and the heat pipe 105. The temperature is detected at three points positioned just below the heater 107 (indicated by solid lines in both the figures), remote from the position just below the heater 107 by 10 cm in the direction of length of the head (one-dot chain lines), and remote from the position just below the heater 107 by 20 cm in the direction of length of the head (dotted lines). Assuming the prescribed temperature to be 50° C., the heater 107 is appropriately turned on and off so that the temperature at the detection point positioned just below the heater holds 50° C. The room temperature is 28° C. and the temperature of the support member 101 is equal to the room temperature before the heater 107 is energized.

As will be apparent from FIGS. 3 and 4, heated temperature control of the support member 101 is ideally achieved by using the heat pipe 105. More specifically, in the case of not using the heat pipe 105, a temperature difference as large as 10° C. at maximum occurs in the direction of length of the head as depicted in FIG. 4, while in the case of using the heat pipe 105, no appreciable temperature difference occurs in the direction of length of the head as depicted in FIG. 3. It is also found that temperature oscillations about the prescribed temperature caused by ON - OFF control of the heater 107 amount to about ±7°–8° C. as depicted in FIG. 4 in the case of not using the heat pipe 105, but are suppressed within ±1° C. as depicted in FIG. 3 in the case of using the heat pipe 105. Thus, no problem occurs in the latter case for providing the uniform heat flux. When the support member 101 reaches the prescribed temperature, ink within the discharge ports is adjusted by restoring means (not shown), and the recording material 108 is now fed by feeding means (not shown) in the direction of b. At the time the recording material 108 reaches a position opposite to the discharge ports of the recording head 112, thermal energy is applied to ink in accordance with an image signal so that the ink is discharged from the discharge ports. Upon reaching the opposite recording material 108, the discharge ink is absorbed by the recording material 108 to form an image thereon.

As the image forming progresses in this manner, as the temperature of the recording head 112 is raised due to heat developed by the thermal energy applied to the ink and remaining in the recording head, so is the temperature of the support member 101. If the temperature detected by the temperature sensor 110 is departed away from the prescribed temperature beyond an allowable range, the controller 111 turns on the fan 109 for blowing air toward the fins 106, thereby to start heat radiation from the recording head 112 through the heat pipe 105.

On this occasion, the contact surface between the heat pipe 105 and the support member 101 serves as the so-called evaporating portion where a larger amount of working liquid is evaporated in an area into which the greater heat flux flows from the support member 101, while a smaller amount of working liquid is evaporated in an area into which the less heat flux flows. Dependent on respective amounts of evaporation, the working liquid takes away larger and smaller amounts of heat for conversion to vapor. In an area into which no heat flux flows, the working liquid once evaporated is condensed there to produce latent heat for supplying calorific power. The vapor phase has no appreciable thermal resistance so that the calorific power is momentarily moved. Therefore, the interface temperature between the working liquid in the evaporating portion and the vapor phase is uniformalized in a moment, allowing the interface temperature to be held almost even when the heat flux flowing into the heat pipe 105 is locally fluctuated. Accordingly, even when the locally fluctuated heat flux flows into the support member 101 in accordance with the image signal, the support member 101 can be held at a substantially uniform temperature due to the above action of uniformalizing the temperature that is developed inside the heat pipe 105. The surplus calorific power exceeding an amount enough to make uniform the interface temperature is momentarily conveyed to the fins 106 where the vapor phase is condensed to produce calorific power. The produced calorific power is transmitted through the fins 106 to an air flow for radiation into surrounding air.

Figure 5:
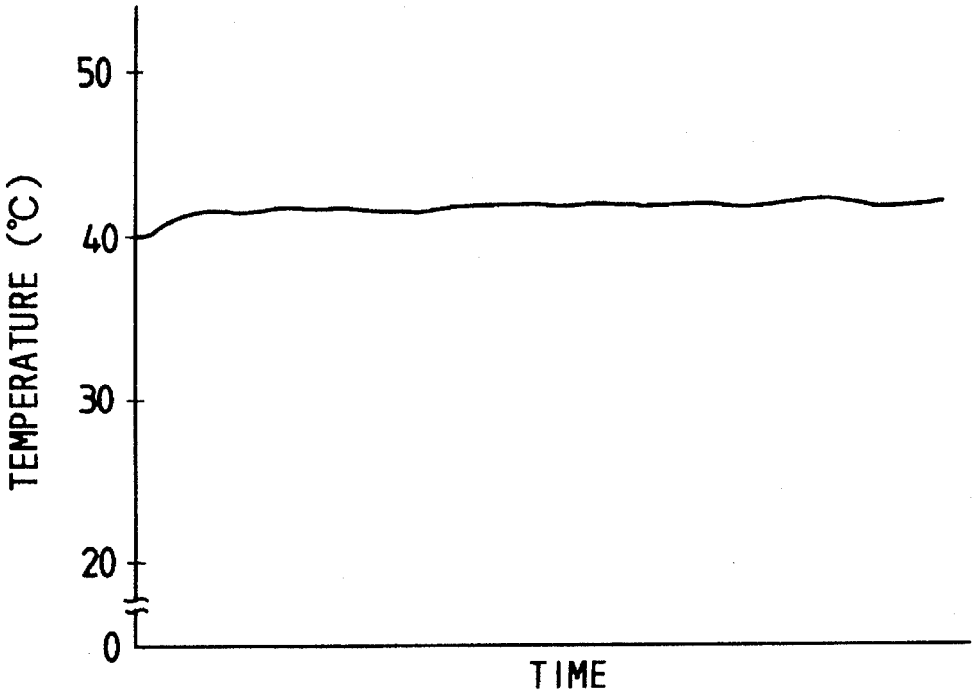
FIG. 5 is a characteristic graph showing temperature changes of a recording head relative to the record lapse time when ink is discharged from all discharge ports of a recording head.
Figure 6:
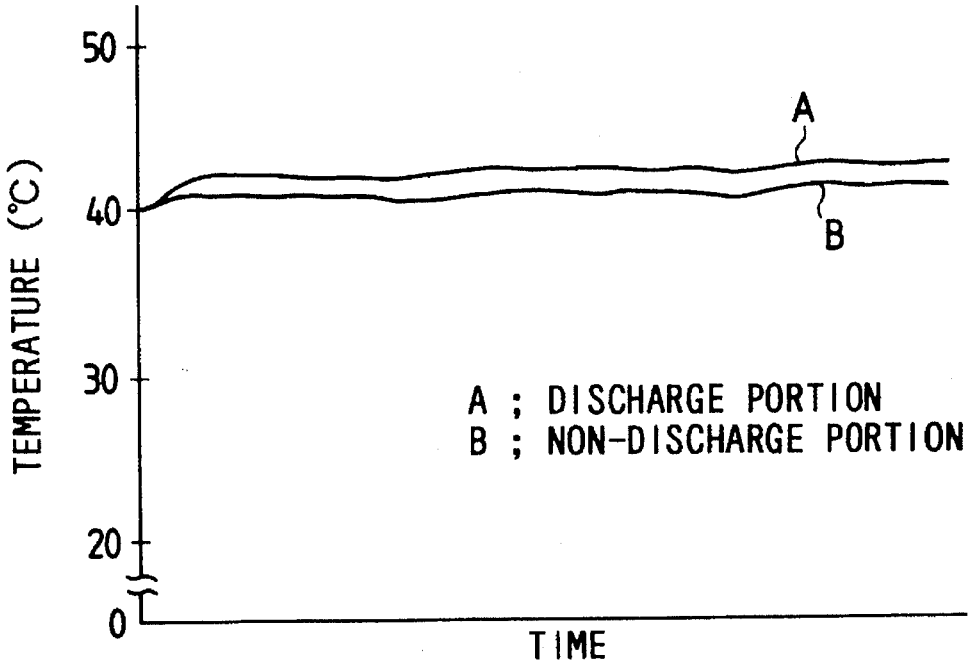
FIG. 6 is a characteristic graph showing temperature changes of a recording head relative to the record lapse time in a discharge portion (area) and a non-discharge portion (area) both of which are defined in a single recording head.

FIG. 5 shows the actually measured data obtained when the fan 109 is appropriately turned on and off to control the temperature of the support member 101 nearly equal to the prescribed temperature through proper heat radiation, while operating the recording head in a full-discharge mode. FIG. 6 shows the actually measured data similarly obtained excepting that the recording head is operated in a discharge mode over one half area and in a non-discharge mode over the other half area. In both the figures, the horizontal axis represents a time and the vertical axis represents a temperature at the boundary between the support member 101 and the heat pipe 105. The room temperature was 26° C.

The origin in each figure represents a time point at which the discharge operation was started after heating the support member 101 by the heater 107 to be controlled equal to 40° C. The fan 109 is controlled by the controller 111 such that it is turned on when the temperature of the support member 101 exceeds above 41° C., and turned off when it drops thereunder. In the case of a full-discharge mode, the support member 101 can be substantially stabilized to hold a steady temperature by appropriately turning on and off the fan 109, as shown in FIG. 5. It should be understood that, in this case, no appreciable temperature variations occur in the direction of length of the head.

In the case of a half-discharge and half-non-discharge mode, the temperature of the support member 101 is suppressed to be as small as 1° C. in difference between the discharge and non-discharge portions thereof, and held in a stable state, as shown in FIG. 6. That temperature difference is attributable to heat resistance of the so-called wick present inside the heat pipe 105. Although the interface between the vapor and the working liquid has a uniform temperature, the temperature difference is caused when the heat flux reaches the heat pipe 105 through the wick. However, the temperature difference of 1° C. between the non-discharge portion (corresponding to a curve indicated by B in FIG. 6) and the discharge portion (corresponding to a curve indicated by A in FIG. 6) of the support member 101 is not virtually problematic in its amount.

This means that the temperature of the support member 101 can ideally be controlled to become almost uniform by radiating heat from the recording head 112 through the heat pipe 105. Therefore, the image recording operation can stably be continued in a state where the controller 111 appropriately turns on and off the fan 109 based on the detected temperature of the temperature sensor 110, thereby holding the temperature of the support member 101 substantially uniform near the prescribed temperature, as explained above. Even in the case of providing a large number of discharge ports, it is thus possible to reduce a degree of variations in the ink temperature between the respective discharge ports, and hence to control the ink temperature substantially uniform, by properly cooling and heating the ink in the discharge ports through the heat pipe.

In short, with this embodiment, since the support member 101 of the recording head 112 is regulated in its temperature through the heat pipe 105, the temperature of the recording head is uniformly adjusted in the direction of length thereof, whereby viscosity of the ink present in all the discharge ports is evenly kept at a predetermined degree, and the ink subjected to thermal energy in accordance with the image signal is carried toward the recording material in a similar discharge state throughout the head region. As a result, the uniform and stable image forming is performed.

Furthermore, when thermal energy is applied to the ink in the respective discharge ports by heat generators for discharging, and the phase change (into bubbles) of a recording liquid is caused with the thermal energy to discharge the ink under an acting force produced upon generation of the bubbles, a difference occurs between amounts of heat radiated to those discharge ports used more frequently and those discharge ports used less frequently from the heat generators for discharging, thereby affecting viscosity of the ink in the discharge ports. With this embodiment, however, since the heat pipe is bonded to the recording head along its length, the caloric power is caused to be immediately transmitted to the heat pipe, even when produced in a larger amount. Then, the heat is transported through the heat pipe such that the ink temperature is held within the substantially same range at any discharge ports used at different frequencies. Accordingly, the temperature of the recording head is averaged over its entire region without being affected dependent on differently used conditions of the respective discharge ports. As a result, viscosity of the ink is also made uniform to provide even and stable ink discharge.

In the embodiment described above, variations in the temperature of the recording head are kept within a range of about ±1° C. by using the heat pipe. Such control is preferably required to meet a temperature control range for recording heads employed in those printers which provide the high image quality while recording images at a high speed, in particular.

On the contrary, those printers in which so high image quality is not necessary and recording is made at a relatively low speed, require not to be so controlled as to meet the similar temperature control range as that in the above high-speed, high-quality printers. The heater and the fan may be controlled in operation to meet a temperature control range of about ±3°–4° C., for instance.

Figure 7:
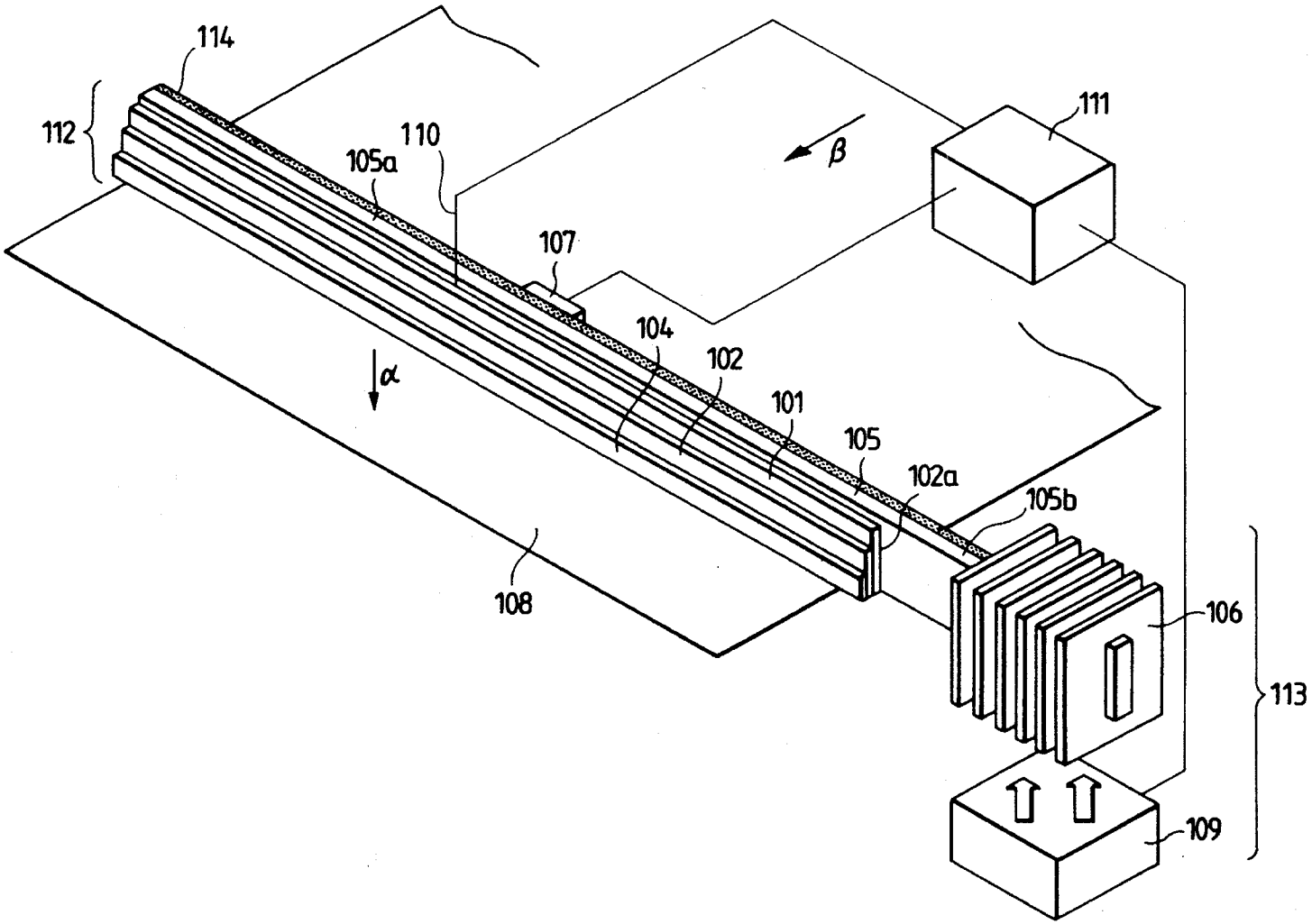
FIG. 7 is a perspective view showing another embodiment of a recording head unit.

FIG. 7 shows another embodiment of a recording head unit. This unit has the basic arrangement similar to that of the above embodiment excepting that a heat insulating material 114 is bonded to a heat pipe 105 substantially all over its one side face opposite to the other side face on which a recording head 112 is joined thereto. For example, polycarbonate, foamed polyurethane, polystyrene and polyester can be used as the heat insulating material 114. The heat insulating material 114 is bonded to the heat pipe 105 using an adhesive or a two-sided adhesive tape. As an alternative, the heat insulating material 114 may be bonded to the heat pipe 105 by fusion or using rivets or the like. Further, the heat insulating material 114 is set to have a predetermined thickness enough to satisfactorily prevent heat from escaping from the heat pipe 105.

Operation of this embodiment will be described below.

When a power supply of the unit is turned on, a heater 107 starts heating the heat pipe 105. Upon heating, a working fluid sealed in the heat pipe 105 starts evaporating from the inner side of the heat pipe 105 in an area contacting with the heater 107. The evaporated working fluid is momentarily spread over the entire inner space of the heat pipe 105, and then condensed to a liquid while radiating the heat of evaporation, when brought to contact with the whole inner surface of the heat pipe excepting the heat applied portion and thereabout. The liquidized working fluid is returned to the portion adjacent the heater by a capillary phenomenon while passing through a wick or the like stretched along the inner surface of the heat pipe. However, since the heat insulating material 114 is bonded to the heat pipe 105 over its one side face opposite to the other side face on which the recording head 112 is joined thereto, the heat of evaporation can hardly be radiated from that one side face of the heat pipe (and hence an amount of working fluid once evaporated and then condensed on that one side face is also small), whereby no appreciable heat is escaped from that one side face to open air. Accordingly, most of all amount of heat generated by the heater 107 is employed to raise a temperature of the recording head 112.

Thus, the inner surface of the heat pipe 105 on the side where the recording head 112 is bonded thereto is supplied with an uniform amount of heat to start raising its temperature in an even manner. Then, a support member 101 bonded to the heat pipe 105 is also increased in its temperature with temperature distribution uniform in the direction of length of the head, so does a base member 102. As a result, ink in all of the discharge ports is allowed to have the same temperature. Viscosity of the ink in all the discharge ports is thus kept at a predetermined adequate degree. When the temperature of the support member 101 reaches a predetermined value, the image recording operation is started and the ink is discharged from the discharge ports in the direction of arrow $\alpha$ in accordance with an image recording signal toward a recording material 108 fed in the direction of arrow $\beta$, thereby for recording an image or the like.

In this embodiment, the heat insulating material 114 is bonded to the heat pipe 105 only over its one side face opposite to the other side face on which the recording head 112 is joined thereto. But, it should be understood that the heat insulating material may be bonded to any other surface of the heat pipe 105 exposed to open air. Since a gap portion between the recording head 112 and the edge of the heat pipe 105 on the side face thereof to which the recording head 112 is bonded is also exposed to open air, the heat insulating material may be bonded to that gap portion.

With the above arrangement, a heat pipe can be provided which has heat efficiency comparable or superior to the heat pipe of the embodiment previously mentioned. In other words, since a heat insulating material is attached to the surface of the heat pipe not in contact with the ink jet recording head, it becomes possible to keep the recording head at a predetermined temperature with a less amount of heat applied, and reduce energy to be applied from the outside.

Figure 8:
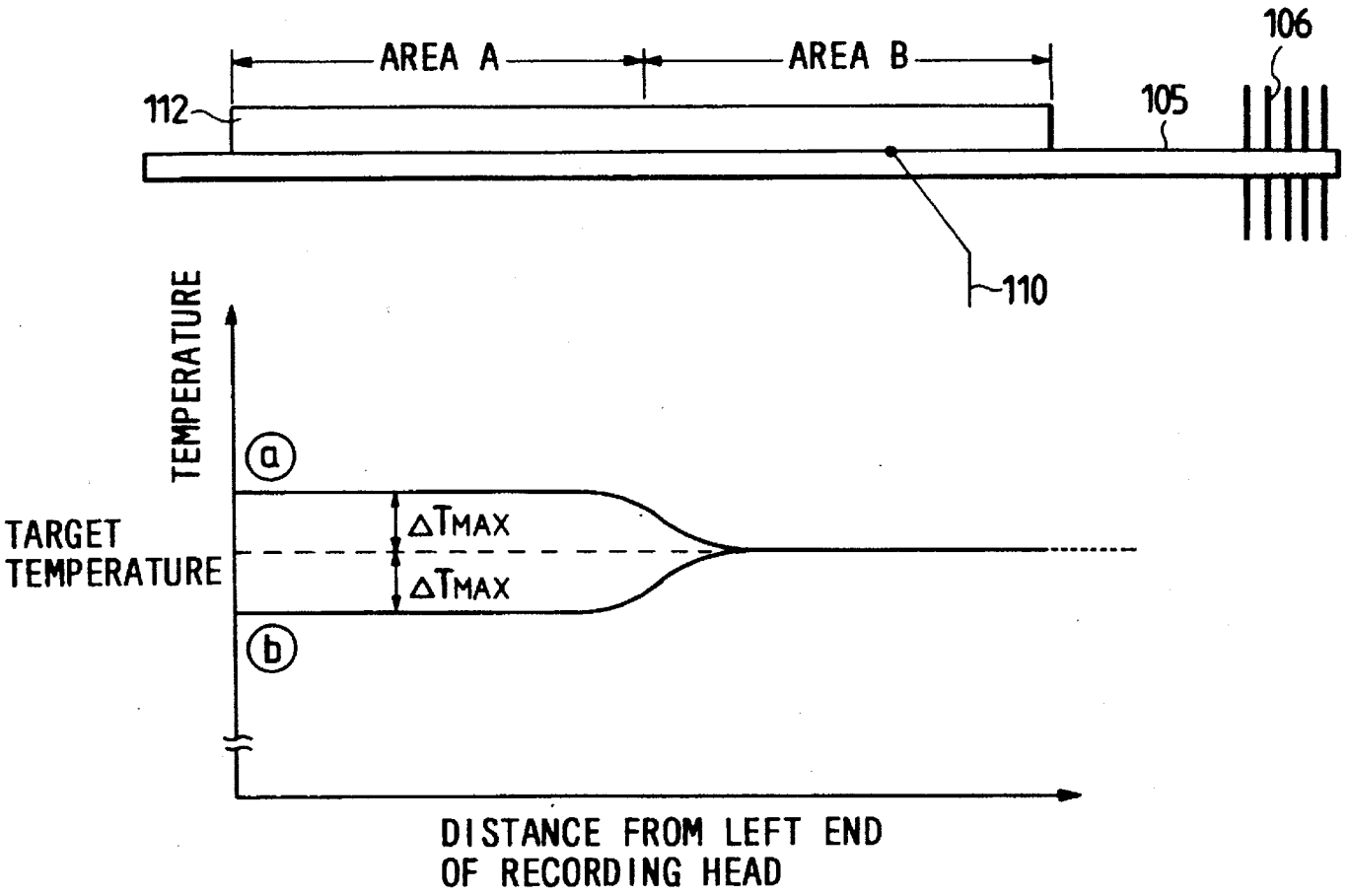
FIG. 8 is a graph showing temperature distribution in the direction of length of a recording head.

Meanwhile, let it be assumed that the maximum range of temperature distribution caused when the heat flux flowing into a head substrate or base member is not uniform is given by $\Delta T_{MAX}$, and that an area A of the recording head is in a discharge mode and an area B is in a non-discharge mode as shown in FIG. 8, for instance. In the case where the temperature detection point is located in a minimum temperature portion over the head substrate, if the temperature detected at that point is controlled to be kept at a predetermined temperature as a control target, the location exhibiting a maximum temperature due to the non-uniform heat flux flowing into the head substrate has a temperature given by (the target temperature $+\Delta T_{MAX}$) as indicated by a curve ⓐ in FIG. 8. On the contrary, when the temperature detection point is located in a maximum temperature portion, the location exhibiting a minimum temperature over the head substrate has a temperature given by (the target temperature $-\Delta T_{MAX}$) as indicated by a curve ⓑ in FIG. 8.

Therefore, temperature fluctuations of the head substrate has a width of $2\Delta T_{MAX}$. Stated otherwise, the head temperature is fluctuated in a width two times the range of temperature distribution derived in principles from the constructional relationship between heat resistance and density of the heat flux flowing into the head substrate. Thus, even if $\Delta T_{MAX}$ is suppressed within an allowable range of fluctuations in the ink temperature through proper setting of the heat resistance and the heat flux density, actual temperature fluctuations of the head substrate may exceed the allowable range under the foregoing temperature control, whereby a proper recording state cannot be maintained.

Taking into account the disadvantageous aspect as stated above, temperature control can be performed with higher accuracy by attaching a temperature sensor 110 onto the outer face of the heat pipe 105, i.e., on the side opposite to its inner face held in contact with the recording head, and covering the sensor 110 with an heat insulating material.

Figure 9:
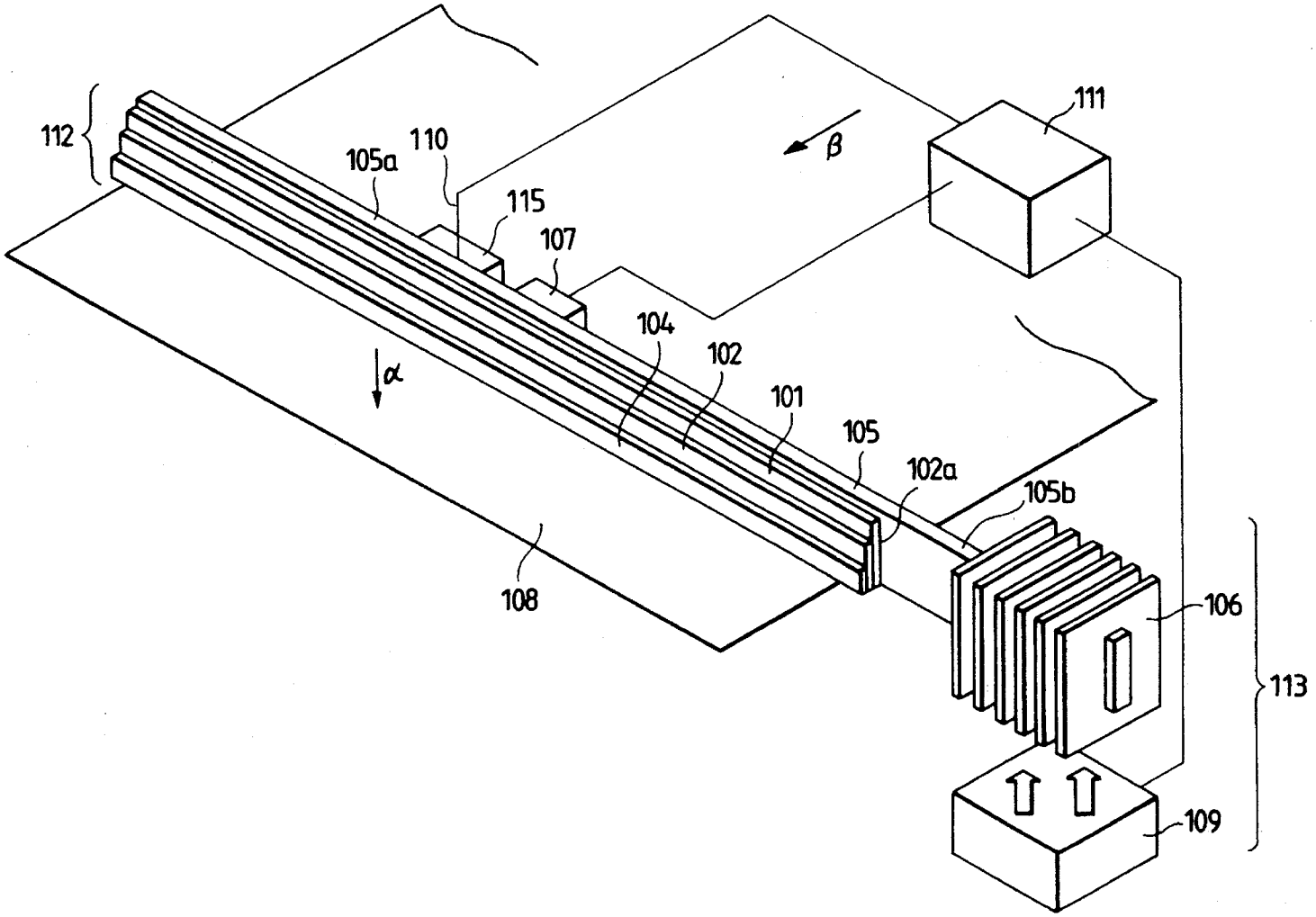
FIG. 9 is a perspective view showing still another embodiment of a recording head unit.

FIG. 9 shows another embodiment of the present invention in view of the above. Features of this embodiment will be described below by referring to FIG. 9. Designated by 115 is a heat insulating material mounted on a heat pipe 105 and made of a raw material having thermal conductivity not larger than 100 W/m.k, preferably resins, foamed plastics or the like having thermal conductivity of 1 W/m.k. The temperature sensor 110 is inserted between the contact surfaces of the heat insulating material 115 and the heat pipe 105. The remaining arrangement and operation sequence are similar to the foregoing embodiments, and hence will not be explained.

Since the heat insulating material 115 is mounted onto the heat pipe 105, heat is hardly escaped from the mounted location to open air so that the temperature at the contact surfaces therebetween becomes nearly equal to the temperature of vapor flow inside the heat pipe 105. Accordingly, detecting the temperature at that contact surfaces and controlling it equal to a predetermined temperature is equivalent to detecting the temperature of vapor flow inside the heat pipe 105, i.e., the temperature of the heat insulated portion, and controlling it.

Figure 10:
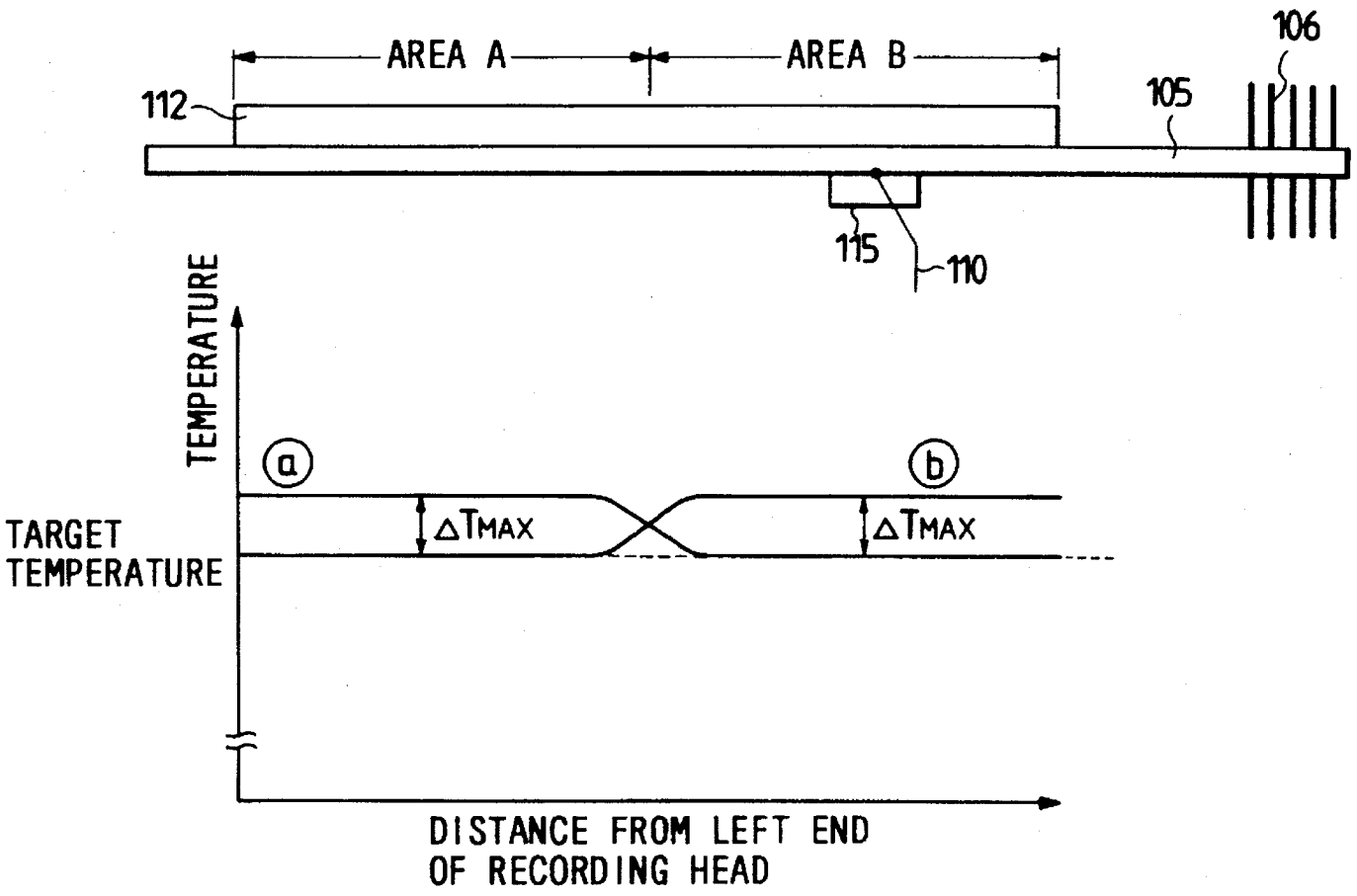
FIG. 10 is a graph showing temperature distribution in the direction of length of a recording head illustrated in FIG. 9.
Figure 11D:
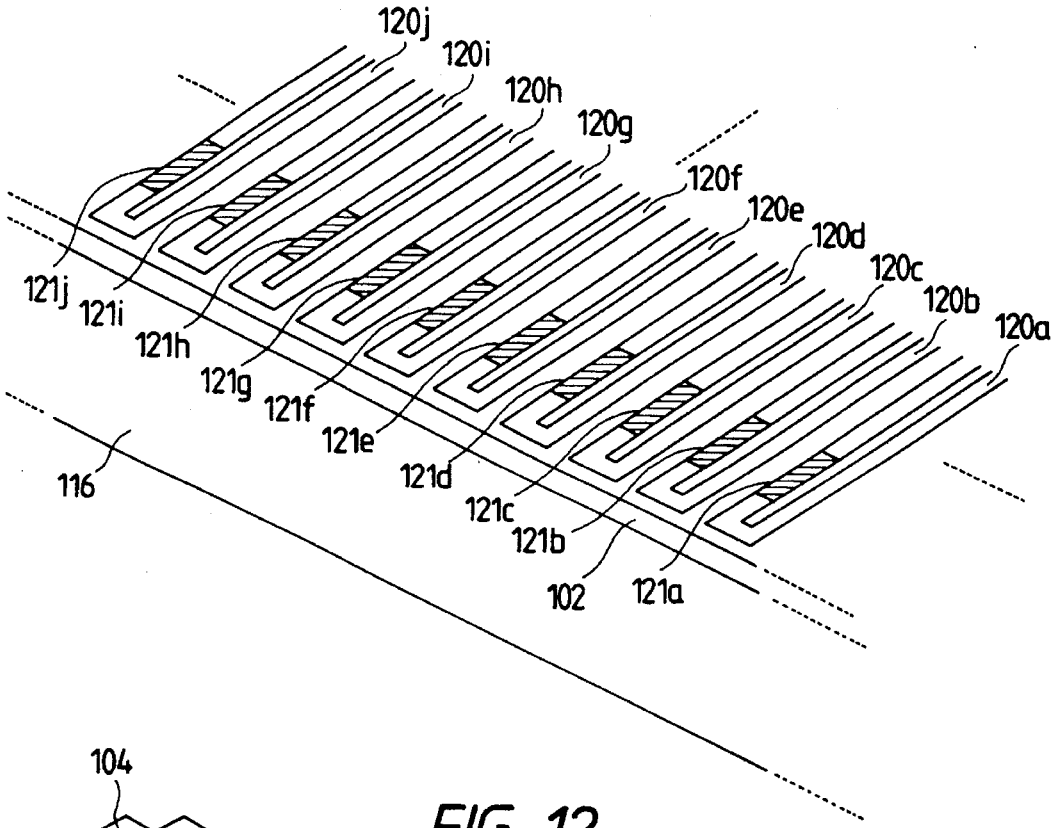

With the above arrangement, when the temperature of the heat pipe 105 at its heat insulated portion is controlled to be held at a target value, the non-heat generating portion of a recording head 112 exhibits the same temperature as that of the heat insulated portion (i.e., control target temperature), and the heat generating portion thereof exhibits a temperature higher $\Delta T_{MAX}$ than the control target temperature. As shown in FIG. 10, therefore, when an area A of the recording head in a discharge mode and an area B is in a non-discharge mode, the area A exhibits a temperature higher $\Delta T_{MAX}$ than the target temperature and the area B exhibits the target temperature, as indicated by a curve ⓐ in FIG. 10. On the other hand, when the area A is in a non-discharge mode and the area B is in a discharge mode, the area A exhibits the target temperature and the area B exhibits a temperature higher $\Delta T_{MAX}$ than the target temperature in a manner simply reversed to the above case (curve ⓑ in FIG. 10).

By controlling the temperature of the heat pipe at its heat insulated portion equal to the target temperature as described above, the temperature of any discharge locations of the recording head can be suppressed within a range of temperature distribution between the target temperature and the target temperature +66 $T_{MAX}$ regardless of distribution of the active discharge locations. As a result, stability of the recording can be improved and image of high quality can be maintained.

In the foregoing embodiments, the recording head 112 is formed on the support member 101 and the heat pipe 105 is jointed to the recording head 112 through the support member 101 for transfer (exchange) of heat between the recording head and the heat pipe, whereby the temperature of the support member 101 is uniformalized throughout the head to make even the temperature of the recording head and hence the ink temperature in the recording head regardless of head areas as well as frequency of discharge.

There will be described below another embodiment in which a heat pipe 105 itself is utilized as a base member 102 for a recording head 112.

Conversely speaking, a recording head unit of the type that the base member 102 of the recording head is employed as one side face of the heat pipe 105 will be explained.

This embodiment has been made based on the following grounds.

A base member mounted to a recording head is mostly formed of silicon because of the need of forming thermal energy generator elements in the form of thin films on the base member in one-to-one relation to the orifices, and of maintaining good thermal conductivity. Meanwhile, a support member for supporting the base member and connecting it to the heat pipe is formed of aluminum in many cases from the standpoints of rigidity, thermal conductivity and reduction in weight. As well known, however, silicon and aluminum are largely different in the coefficient of expansion ($2.6\times10^{-6}$ and $23.1\times10^{-6}$ at 20° C., respectively). When silicon and aluminum are totally bonded to each other at their contact surfaces, the assembly may be damaged or broken due to strain stress caused by temperature changes. On the other hand, when the base member and the support member are partially bonded to each other at discrete points to satisfactorily absorb the strain stress, air may be trapped in the gaps between the two members at their non-contact portions, thus resulting in large heat resistance.

Accordingly, by designing the base member to serve directly as a material constituting a part of the heat pipe, an arrangement can be resulted in which the heat resistance is reduced, and the strain stress due to temperature changes is less developed.

One embodiment of a recording head unit of the type that the recording head and the heat pipe are directly connected together will be described below in detail with reference to FIGS. 11A through 11D. In these figures, designated by 112 is a recording head which includes an ink chamber having a large number of orifices 103 arranged side by side in the direction of width of a recording paper. The recording head 112 is bonded to a base member 102 made of silicon or any other desired material on the surface of which are formed thermal energy generator elements 121*a*–121*n* and conducting circuits 120*a*–120*n* in one-to-one relation to the orifices 103 by the thin film technology. The base member 102 is placed on a recessed or channel-like member 116 in such a manner as to close an opening 116a thereof, and bonded to the recessed member 116 at opposite side walls 116*b*, 116*b* thereof, thereby to jointly constitute a heat pipe. In this case, the recessed member 116 is preferably formed of amorphous silicon, polycrystalline silicon or ceramics, for example, which has the coefficient of expansion close to that of monocrystalline silicon. In the figures, reference numerals 117*a*, 117*b* designate shield members fitted to enclose the opposite ends of the recessed member 116 and preferably formed of the same materail as the recessed member 116. Then, a heater 107 is attached to the base member 102 and cooling fins 106 are mounted on an extended-portion of the heat pipe composed of the base member 102 and the recessed member 116, thereby constituting a recording head unit.

In the recording head unit, as with the above cases of using the heat pipe as an independent component, a controller (not shown) is operated in response to a detected signal from a temperature sensor (not shown) to energize the heater 107 or actuate a cooling fan (not shown), so that an air flow is blown toward the cooling fins 106 to regulate a temperature of the heat pipe for carrying out temperature control of the recording head.

Accordingly, by selecting such a material for the heat pipe as well compatible with connection to silicon, i.e., having the coefficient of expansion close to that of silicon, sufficient adhesiveness can be ensured, heat resistance is lowered, and strain stress due to temperature changes is reduced. It is also possible to ensure rigidity necessary for the support member by virtue of the hollow structure.

In short, with this embodiment, since the base member mounting the recording head thereon is constituted as a part of the heat pipe so that a working medium within the heat pipe is brought into direct contact with the base member, heat resistance is lowered to effectively make the heat flux uniform, while ensuring necessary rigidity and reducing strain stress due to temperature changes.

There will now be described another embodiment in which one side wall of a heat pipe is employed as a base member of a recording head.

Figure 12:
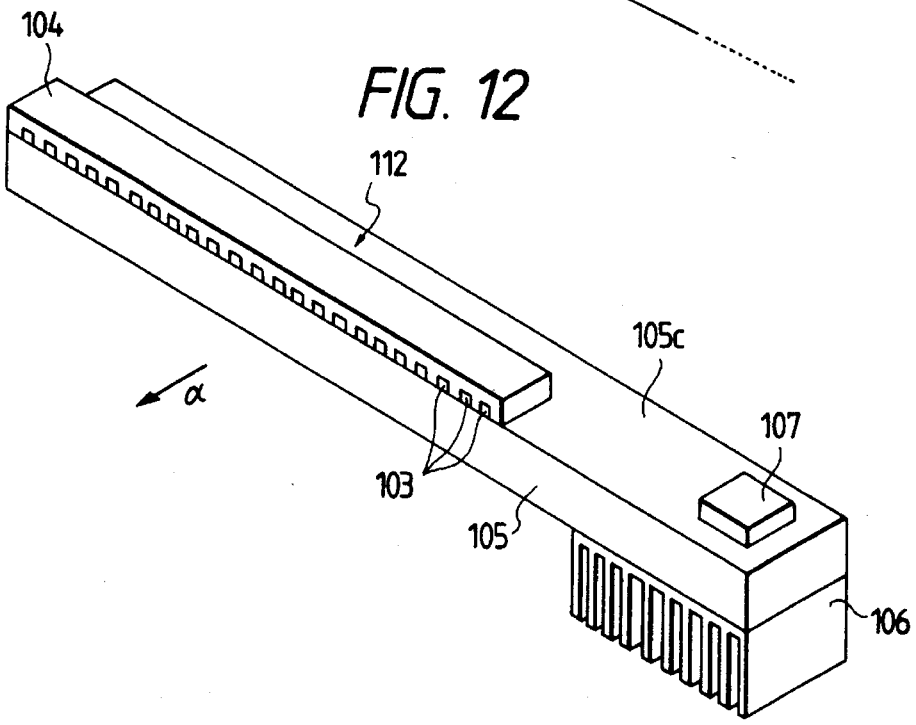
FIG. 12 is a perspective view showing still another arrangement example of a recording head unit.

FIG. 12 is a perspective view of a recording head unit according to this embodiment.

Designated by 112 is a recording head. 104 is a top or ceiling plate formed of glass, resin or other suitable material. 103 are discharge ports through which ink is discharged. Each discharge port 103 is communicated with a not-shown groove (or recess) defined in the lower surface of the top plate 104, as viewed on FIG. 12, in a direction perpendicular to the direction of length thereof. The respective grooves are communicated at their rear side with a single common ink groove (or recess) defined in the direction of length of the top plate 104.

105 is a plate-like (rectangular parallel-piped) heat pipe which is machined to a planar surface 105*c* at least in its surface connected to the top plate 104, and entirely formed of monocrystalline silicon in this embodiment. The heat pipe 105 includes a wire net wick or the like disposed in its inner space, and is filled with a working liquid such as water or alcohol in a sealed manner. The planar surface 105*c* of the heat pipe 105 and the top plate 104 are joined to each other with the recesses (or the discharge ports) of the top plate being directed inward, thereby to form liquid passages. In a selected area of the upper planar surface 105*c* of the heat pipe 105, there is provided a heating portion (not shown) of the bubble jet system to apply thermal energy to ink in the liquid passages for discharging the ink.

The heating portion is formed by placing or depositing an insulating film directly on the heat pipe 105, arranging heat generators thereon respectively associated with the liquid passages to produce heat when energized, forming electrodes (wiring patterns) to supply electric power to the respective heat generators, and placing an insulating protective layer over the heat generators and the electrodes.

In this embodiment, since the heating portion is directly provided on the heat pipe, the heat resistance between the heat pipe and the ink in the respective liquid passages is reduced and heat is smoothly transferred between the heat pipe and the ink in the respective liquid passages. This reduces a difference between the temperature of the ink in the respective liquid passages when heated by the heat generators before operation and the temperature of the ink in the respective liquid passages when cooled through heat radiating fins during operation, whereby a difference in viscosity of the ink between the above two states is also reduced. It is thus possible to maintain the discharged ink in a substantially steady condition at all times. Further, since heat is smoothly transferred between the heat pipe and the ink in the respective liquid passages, difference in ink temperature between those liquid passages discharging the ink therethrough and those liquid passages discharging no ink during the recording operation becomes small, so does a difference in viscosity of the ink therebetween.

Moreover, since the heating portion is provided on the heat pipe formed of monocrystalline silicon, this embodiment can provide several additional advantages. The heat pipe has very excellent thermal conductivity, so that heat transfer through the heating portion between the working liquid in the heat pipe and the ink in the respective liquid passages defined in the top plate is made very efficiently. In addition, the thin film structure of the heating portion can easily be fabricated.

Although the heat pipe is entirely formed of monocrystalline silicon in this embodiment, it is also possible to form the heat pipe using monocrystalline silicon for only the part on which the heating portion is provided, and using other suitable material for the remaining parts.

In short, with this embodiment, the heat resistance between the heat pipe and the ink in the liquid passages becomes so small that the recording liquid in nozzles may be controlled by the heat pipe with higher response. As a result, the stable discharging and recording condition can be maintained during the recording operation.

In the last two embodiments, a part of the heat pipe formed of silicon, which is a material for the substrate of the recording head, is employed as the support member or base for the recording head.

As an alternative, the heat pipe can be fabricated by using suitable metals, e.g., aluminum, as a material for the base member. For instance, heat generator elements and others may be formed directly on an aluminum base, which is then used as one side wall of the heat pipe. Alternatively, heat generator elements and others may be formed directly on one side face of an aluminum-made heat pipe.

Meanwhile, in such a case of forming a full-color image, a plurality of recording head units are arranged side by side in the direction of feeding of a recording material or paper.

Figure 13:
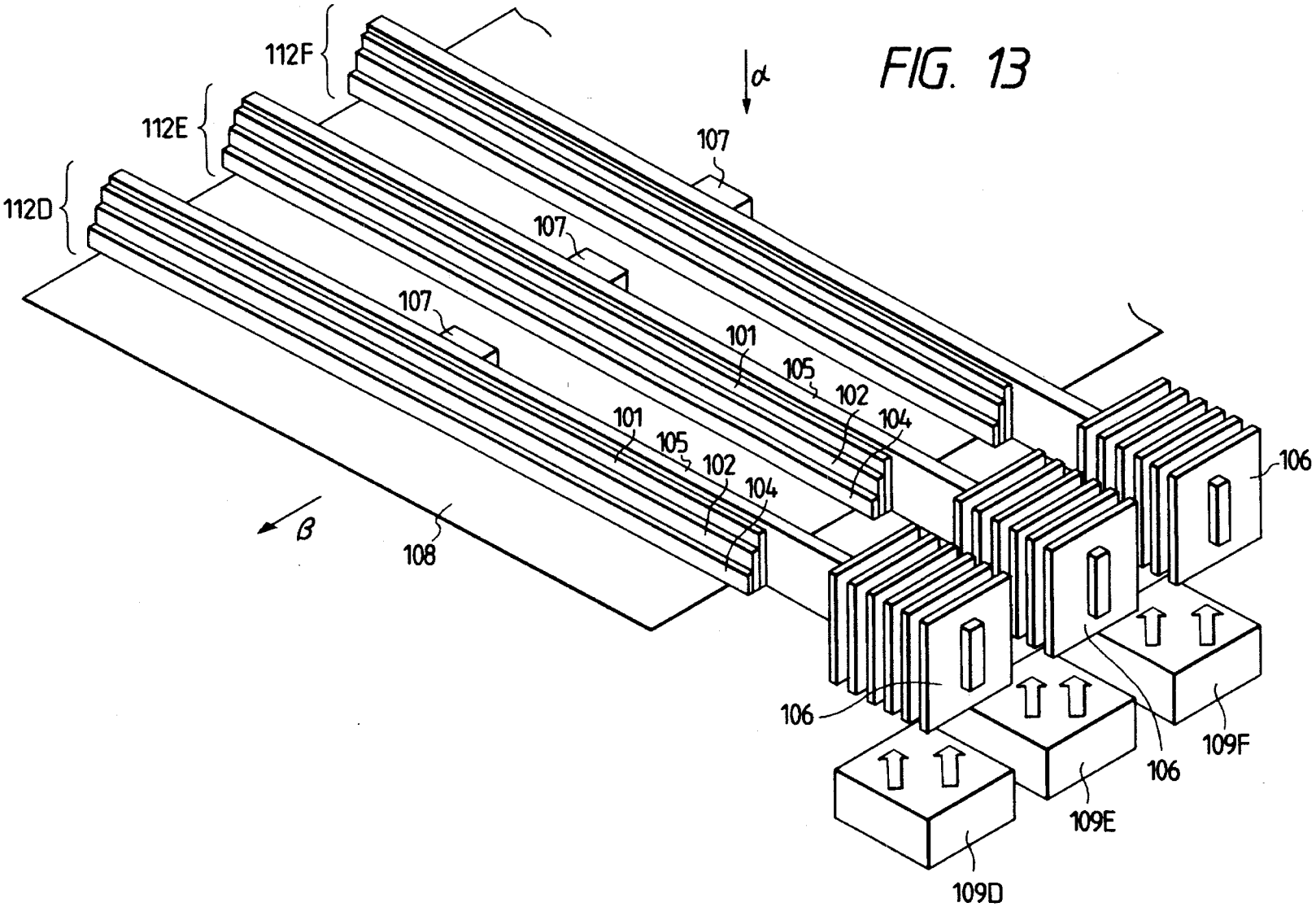
FIG. 13 is a perspective view showing one example in which a plurality of recording head units of one example are mounted.

FIG. 13 is a perspective view showing a state where three recording head units 112D, 112E, 112F are arranged in the direction of feeding of the recording material. Each of the recording head units is similarly constructed as that described in connection with FIG. 5. Therefore, the same members in FIG. 13 as those in FIG. 5 are designated by the same reference numerals. It is to be noted that such members as a sensor and a controller are omitted for brevity of the explanation.

When the recording operation is started, ink is discharged from the recording head units 112D, 112E, 112F in accordance with the position of a recording material 108 and an image signal, so that different colors of ink are successively superposed on the recording material 108 to form an image.

The recording head units can be arranged in the direction of feeding of the recording material 108 by inserting them into a recording apparatus in the direction of length of the units to be properly set in respective installed positions.

Figure 14:
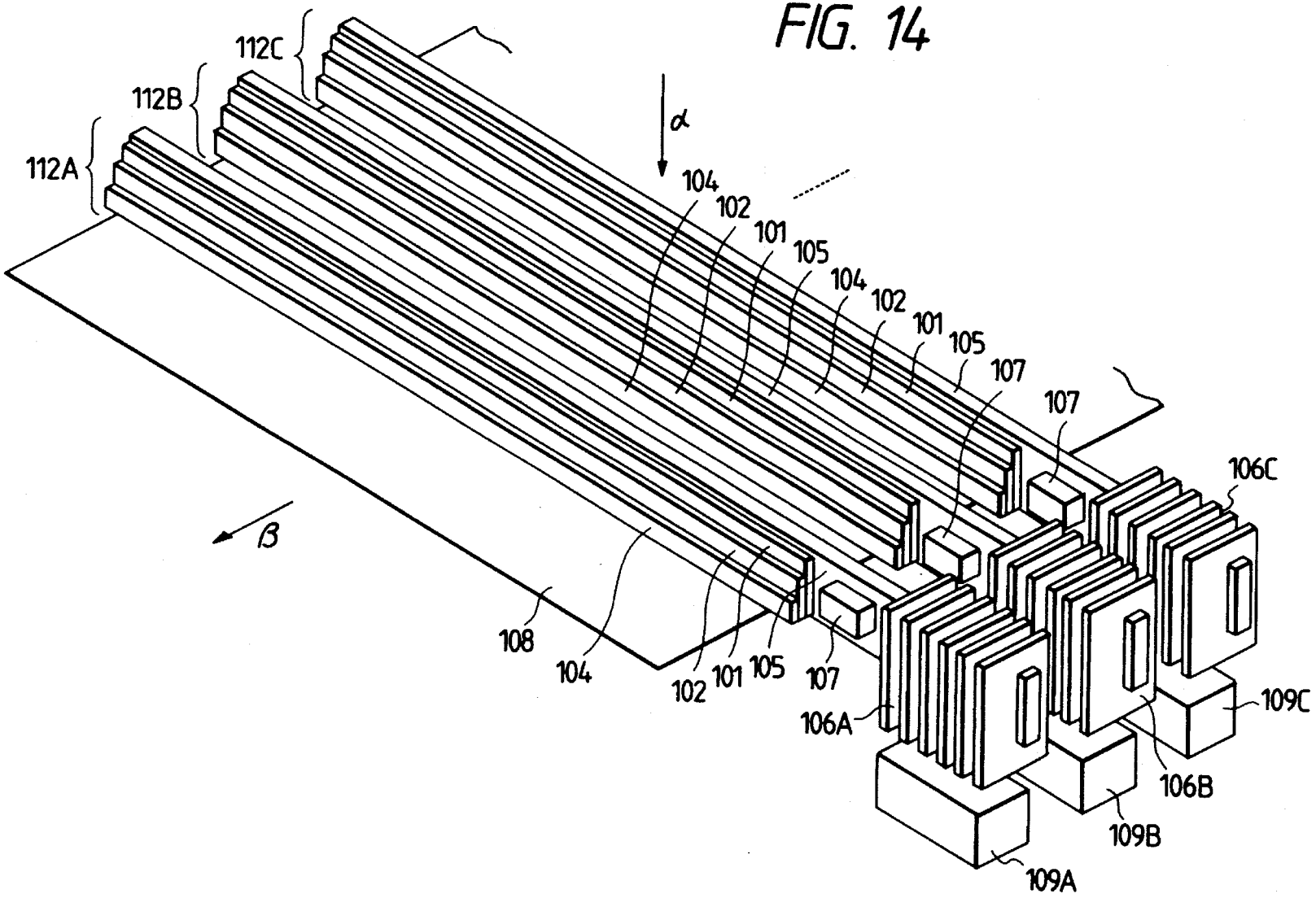
FIG. 14 is a perspective view showing another example in which a plurality of recording head units are mounted.
Figure 15:
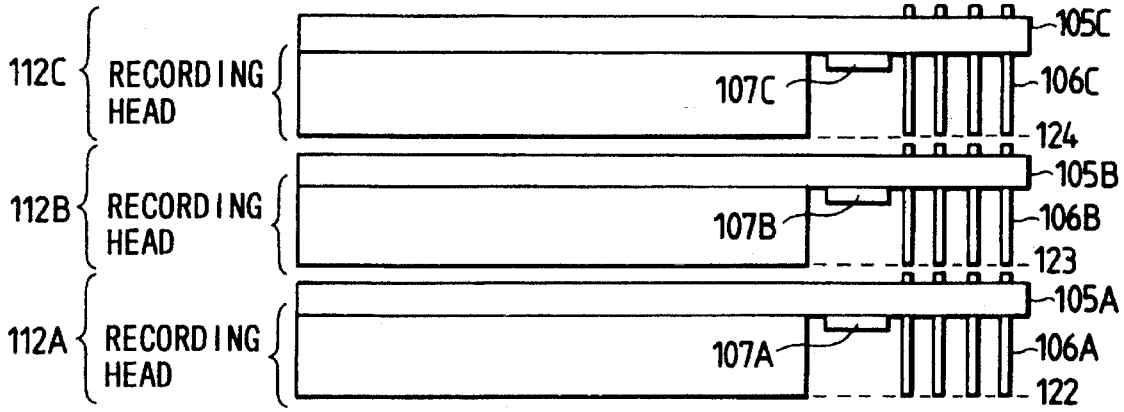
FIG. 15 is a top plan view of FIG. 14.

FIG. 14 is a perspective view showing a state in which recording head units according to another embodiment of the present invention are arranged side by side in a recording apparatus. FIG. 15 is a top plan view of FIG. 14. As with the above embodiment described in connection with FIG. 13, each recording head 112 comprises a support member 101, a base member 102 and a top plate 104. The recording head 112 is joined to one side face of a plate-like heat pipe 105. A heater 107 is disposed on the same side face of the heat pipe 105 as that on which the recording head 112 is joined thereto.

Heat radiating fins 106 are disposed in a position at the end of the heat pipe 105 and adjacent to the heater 107. The heat radiating fins 106 are offset such that a larger part of each fin is disposed on the same side as the recording head 112. More specifically, the heat radiating fins 106 are constituted by arranging a plurality of flanges 106*a* with predetermined intervals therebetween such that the flanges are extended perpendicularly to the direction of length of the heat pipe 105. Then a larger part of each fin is projected on the same side as the recording head 112.

In other words, the flanges 106*a* are projected in a less amount on the side of the heat pipe 105 opposite to the recording head 112. A projected amount of the heat radiating flanges 106*a* on the side opposite to the recording head 112 is set such that when the plurality of recording head units are installed in the apparatus side by side with predetermined intervals therebetween, the flange edges will not extend beyond an extension of the side face of the recording head of the adjacent recording head unit. Further, a projected amount of the heat radiating flages 106*a* on the same side as the recording head 112 is adjusted such that the total sum of an amount of the fins 106 on the same side as the recording head, a projected amount of the fins 106 on the side opposite to the recording head, and a thickness of the heat pipe 105 becomes smaller than an array pitch of the recording head units mounted side by side.

There will now be described how to mount the recording head units 112A, 112B, 112C, each constructed as above, side by side as shown in FIGS. 14 and 15.

The recording head unit 112A is first mounted in place. Then, the recording head unit 112B is inserted from the right side such that the side face of the recording head of the unit 112B extends along a dotted line 123 defined as a line along which that side face of the recording head is to be positioned. Since the projected amount of the fins 106A of the recording head unit 112A on the side opposite to the recording head is set such that the fin edges will not extend beyond the extension 123 of the side face of the recording head of the unit 112B, the recording head of the unit 112B does not strike against or interfere with the fins 106A of the unit 112A, thereby allowing the unit 112B to be mounted from the right side. This is equally applied to the case of mounting the unit 112C after mounting of the unit 112B.

Also, when mounting the unit 112C and the unit 112B in this order, the unit 112B can be similarly mounted by inserting it from the right side, because the heat radiating fins 106B of the unit 112B are projected in a slight amount on the side opposite to recording head thereof, and the total sum of an amount of the fins 106B on the same side as the recording head, a projected amount of the fins 106B on the side opposite to the recording head, and a thickness of the heat pipe 105 is set smaller than an array pitch of the recording head units.

As described, with this embodiment, since the heat radiating fins are arranged such that a larger part of each fin is projected on the same side as the recording head, the recording head units can be mounted without causing interference therebetween, even when the spacings of the recording head units are set small. This permits a reduction in the size of the ink jet recording apparatus.

Further, since the heater 107 is disposed on the same side as the recording head, the spacings of the recording head units can be further reduced. More specifically, when the heater 107 is disposed on the side opposite to the recording head, the array pitch of the recording head units must be set not smaller than the total sum of a thickness of the heater 107, a thickness of the heat pipe 105 and a thickness of the recording head. However, when the heater 107 is disposed on the same side as the recording head, the array pitch of the recording head units can be reduced to a minimum value, i.e., the sum of a thickness of the heat pipe 105 and a thickness of the recording head, with the result that the apparatus can be further reduced in its size. It is also possible to improve accuracy of registration between the recording head units.

In short, with this embodiment arranged such that the heat pipe is interposed between the ink jet recording head and the heater for adjusting the temperature of the recording head through the heat pipe, it becomes possible to easily adjust a temperature of the entire recording head, and to evenly hold viscosity of ink in all the discharge ports at an intended value, so that the uniform condition of ink discharge is obtained at the respective discharge ports to provide stable recording.

Furthermore, with the arrangement that heat radiating members are disposed on the surface of the heat pipe in contact with neither the recording head nor the heater, the stable recording can be performed while keeping the temperature of the recording head nearly equal to the prescribed temperature.

Still another embodiment in which a plurality of recording heads are arranged will be described below with reference to FIG. 16.

In this embodiment, two recording heads are attached to the opposite side faces of a single plate-like heat pipe, respectively.

Figure 16:
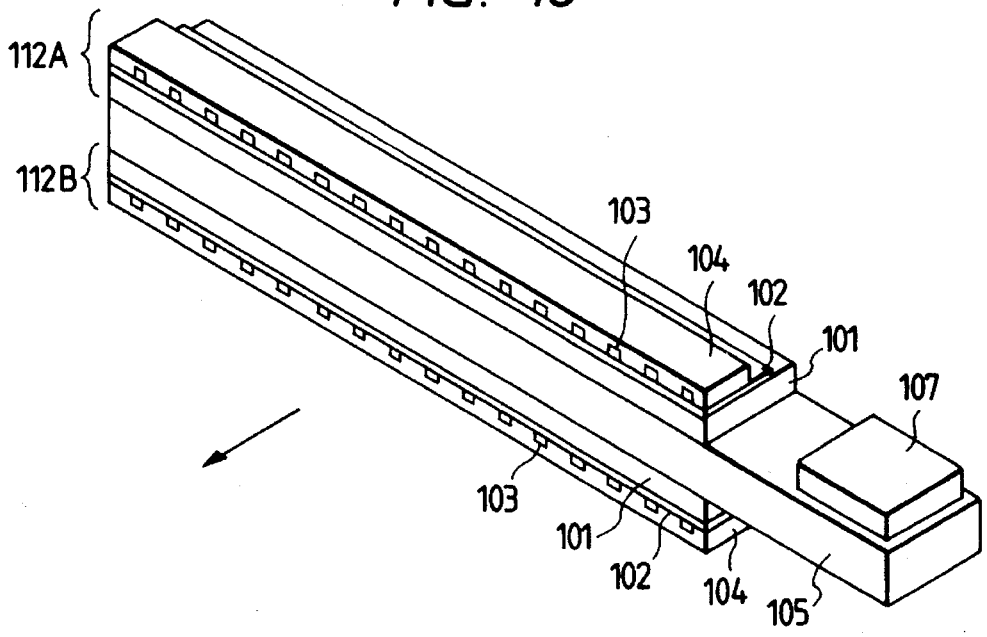
FIG. 16 is a perspective view showing one example in which a plurality of recording heads are joined to a single heat pipe.

In FIG. 16, designated by 112A, 112B are recording heads each of which comprises a top plate 104 formed with discharge ports 103, a base member 102 including a heating portion of the bubble jet system to apply thermal energy to ink in the discharge ports 103 for discharging the ink therethrough, and a support member 101 for supporting both the top plate 104 and the base member 102. 105 is a plate-like heat pipe fabricated to have a length longer than that of the recording heads 112A, 112B in this embodiment. Then, the recording heads 112A, 112B are bonded to the opposite side faces of the heat pipe 105 in symmetrical relation, respectively, with their support members 101 facing inward. Such bonding of the heads is made using an adhesive with good thermal conductivity, or the like. On a portion of the heat pipe 105 projecting from the recording heads 112A, 112B, there is bonded heater 107 on the same side face on which the recording head 112A, with a certain spacing left relative to the recording head 112A.

At one end of the heat pipe, though not shown, there are mounted fins as heat radiating members and a fan for enhancing the heat radiating ability. Further, a temperature sensor is provided at a proper location on the heat pipe, and the detected temperature is transmitted to a controller so that it controls operation of the fan and the heater 107 based on the detected temperature for keeping the recording heads at a prescribed temperature.

Figure 17:
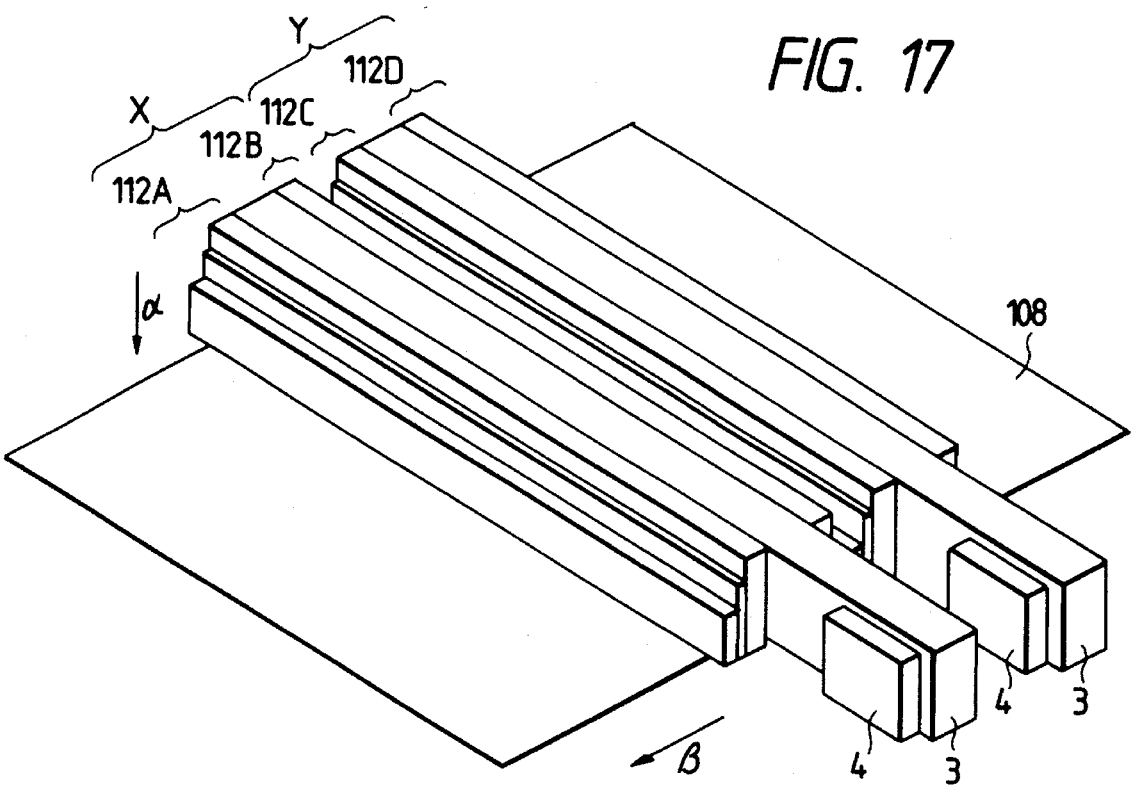
FIG. 17 is a perspective view showing one example in which a plurality of recording head units, one of which is shown in FIG. 16, are mounted.

A plurality of recording head units thus constructed according to this embodiment are arranged side by side to constitute a recording apparatus, as shown in FIG. 17. More specifically, designated by X, Y are recording head units each constructed in the same manner as the recording head unit of FIG. 16. The recording head units X, Y are arranged side by side such that the respective projected portions of the heat pipes 105 are positioned on the same side, and the respective heaters 107 are projected in the same direction. In the case of employing three or more recording head units, they are arranged successively in similar fashion. At this time, a spacing between the recording heads of the units X, Y adjacent to each other is set equal to a thickness of the heat pipe for achieving proper registration between the recording heads.

With this embodiment, in particular, since two recording heads are bonded to the opposite side faces of a single heat pipe, respectively, the number of heat pipes used can be reduced to permit a great reduction in the cost. Furthermore, since the installation space is saved by an amount corresponding to one heat pipe per two recording heads as compared with the case of associating one heat pipe with each recording head, the spacing between the recording heads can be made smaller, and the apparatus size can be reduced in the direction of feeding of the recording material.

There have been explained before various arrangements adapted to make uniform temperature adjustment for the entire recording head of the full-line type. It should be however understood that the present invention is also applicable to recording heads for use in printers of the so-called serial type in which a carriage mounting a recording head thereon is scanned for recording.

A recording head unit for use in a serial printer will be described below.

One embodiment of the type recording head unit to which the present invention is applied will now be explained in detail by referring to the drawings.

Figure 1:
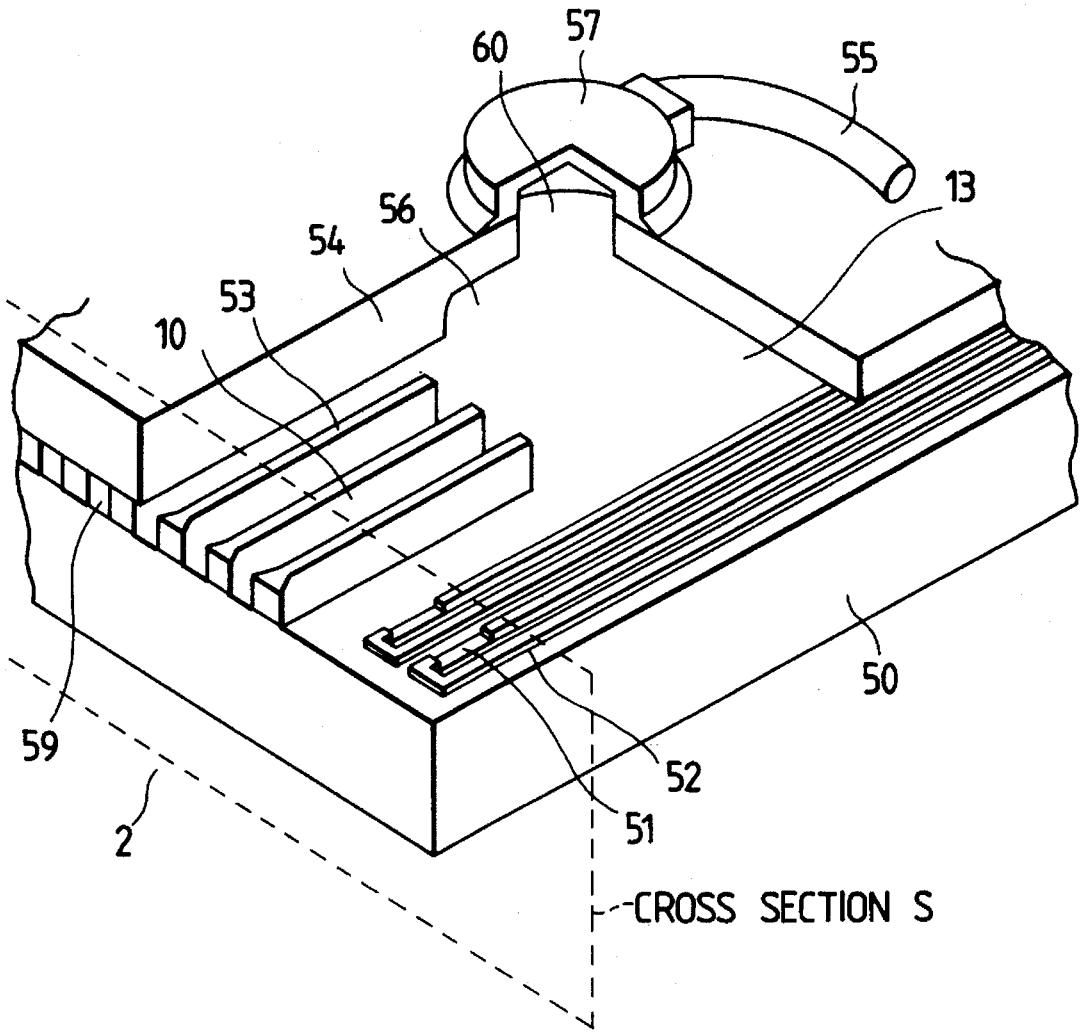
FIG. 1 is a perspective view for partially showing one example of a recording head which employs thermal energy generator means.
Figure 18:
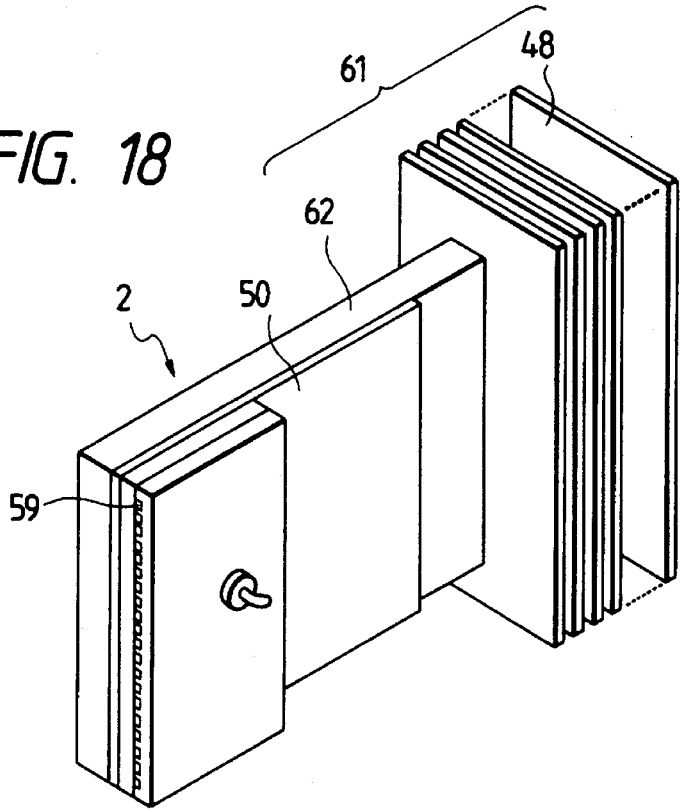
FIG. 18 is a perspective view showing one example of a recording head unit in which a heat pipe is attached to a serial type recording head.

FIG. 18 is a schematic side view of an ink jet recording head unit for illustrating this embodiment. The similar components in FIG. 18 as those in FIG. 1 are designated by the same reference numerals and will not be explained. In FIG. 18, heat exchanger means 61 is provided which comprises a first heat exchanging portion held in contact with one side face of a recording head 2 for heat exchange, and a second heat exchanging portion positioned in the outside remote from the recording head, the recording head 2 being formed with a plurality of electro-thermal transducers used for discharging ink.

Specifically, the heat exchanger means 61 comprises a connector portion 62 (first heat exchanging portion) joined to the lower surface of a base plate 50 formed of silicon, glass or the like to serve as a heat transmitting portion for introducing heat in liquid passages 10 (see FIG. 1) through the base plate 50, and a heat radiating fin 48 formed in continuous relation to the connector portion 62 on the side opposite to ink discharge ports 59 such that it is positioned behind the recording head and serves as a heat radiating portion (second heat exchanging portion). The heat radiating fin 48 is composed of plural fin members for enhancing the heat radiating ability. The connector portion 62 and the heat radiating fin 48 are preferably formed of a material having good thermal conductivity such as Cu or Al, more preferably Al because of light weight.

With this embodiment, since the heat exchanger means 61 formed by a heat pipe having excellent heat exchange characteristics is joined to the lower surface of the base plate 50 on which electro-thermal transducers 51 of the recording head 2 are disposed, surplus or retained heat generated by the electro-thermal transducers 51 of the recording head 2 and remaining therein can quickly by transmitted from the side near the ink discharge ports to the side near the common liquid chamber behind the head through efficient heat exchange, so that the ink temperature is less likely to change and made uniform in distribution thereof. As a result, the ink temperature in the recording head can be kept at a certain value, and changes in the diameter of recording ink dots can be suppressed as small as possible.

Figure 19:
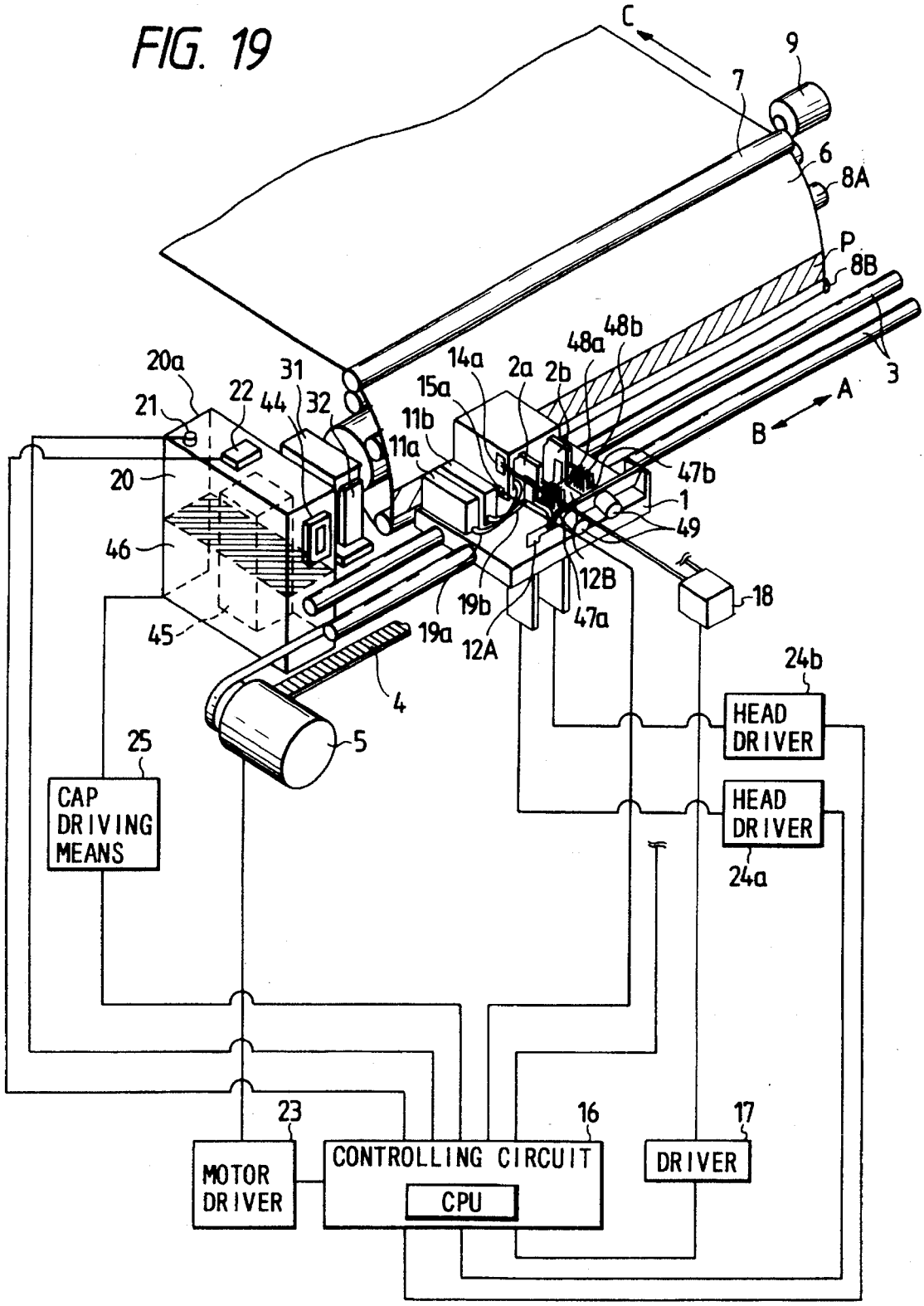
FIG. 19 is a perspective view showing one example of a recording apparatus in which a recording head unit shown in FIG. 18 is mounted.

FIG. 19 is a schematic perspective view showing one arrangement example of an ink jet recording apparatus incorporating the above recording head unit.

In FIG. 19, designated by 1 is a carriage which mounts thereon a pair of recording heads 2*a* and 2*b*, each similar to that shown in FIG. 18, formed with heat exchanger means 61*a* and 61*b*, respectively. The carriage 1 is movably mounted on a pair of guide rails 3. 4 is an endless belt which is connected at its part to the carriage 1. 5 is a drive motor (pulse motor). When the drive motor 5 is driven, the carriage 1 is moved via the belt 4 on the guide rails 3 along the recording surface of a recording sheet 6. 7 is a roller for feeding the recording sheet 6, 8A and 8B are guide rollers for guiding the sheet 6, and 9 is a sheet feeding motor.

Meanwhile, ink is supplied to the recording heads 2*a* and 2*b* from ink tanks 11A and 11B through supply tubes 12*a* and 12*b*, respectively. An electric signal for discharging ink is selectively supplied through flexible cables 12A and 12B to electro-thermal transducers (not shown) provided in the respective liquid passages as discharge energy generator means. Further, the recording heads 2*a* and 2*b* have head heaters 14*a* and 14*b* for heating the respective heads, and means 15*a* and 15*b* for detecting temperatures of the respective heads. Detection signals from the temperature detecting means 15*a*, 15*b* are input to a controlling circuit 16 which includes a CPU. Based on the detection signals, the controlling circuit 16 controls the head temperatures by changing amounts of heat produced by the head heaters 14*a*, 14*b* through a driver 17 and a power supply 18. With the action of the heaters and the fins, the temperatures of the recording heads can easily be kept uniform.

Designated by 20 is capping means brought into abutment against the surfaces (discharge port surfaces) of the recording heads 2*a* and 2*b* in which their discharge ports are disposed, while the apparatus is in a non-record mode. Thus, during a non-record mode, the recording heads 2*a* and 2*b* are moved to a position opposite to the capping means 20. Afterward, the capping means 20 is moved forward by cap driving means 25 so that an elastic member 44 is brought into abutment against the discharge port surfaces for capping the recording heads to protect the discharge ports and prevent clogging.

Temperature detecting means 21 and 22 are attached onto the capping means 20 to monitor the recording environment of the recording heads 2*a* and 2*b*. Furthermore, the capping means 20 contains a volatile component solution 46 of the ink in its sealable space 20A, and houses therein a liquid retaining member 45 impregnated with the solution 46. The space 20A is thereby filled with volatilized vapor of the solution to prevent the volatile component of the ink from evaporating through orifices of the nozzles 10, so that the content ratio of the volatile component of the ink remains unchanged in the nozzles 10.

The volatile component solution 46 is advantageously ink itself or a residual component solution resulted by removing dyes from the ink. In the case of aqueous ink, the solution 46 is advantageously distilled water. The liquid retaining member 45 is preferably formed of an ink absorbing material, particularly preferably a sponge-like porous material, sintered plastics or the like.

Designated by 31 is means for receiving droplets discharged during the idle discharging operation. Thus, the means 31 includes a liquid retaining member 32 positioned facing the recording heads 2*a* and 2*b* to absorb the ink idly discharged therefrom, and is disposed between the capping means 20 and a record starting position. As with the capping means 20, the liquid retaining member 32 is advantageously formed of a sponge-like porous material, sintered plastics or the like.

In this embodiment, it is not necessarily required to provide a fan for blowing air toward the fins mounted on the heat pipe. This is because the number of discharge ports in this embodiment is less than that necessary for the head of the full-line type, and only the fins suffice for the satisfactory heat exchanging ability.

In FIG. 19, however, a plurality of cooling fans 49*a* and 49*b* are provided to enhance the heat radiating ability of the fins 48*a* and 48*b* of the heat exchanger means 61*a* and 61*b* associated with the recording heads 2*a* and 2*b*, respectively. The cooling fans 49*a* and 49*b* enable more positive control of the ink temperature.

The cooling fans 49*a* and 49*b* are provided on the carriage 1 which mounts the recording heads 2*a* and 2*b* thereon, and are arranged such that the fans blow air at an inclination in an angle range of −90 to +90 degrees with respect to the direction perpendicular to the heat radiating surfaces of the heat radiating fins 48*a* and 48*b*. However, the cooling fans 49*a* and 49*b* are not arranged at an inclination angle of 0 degree. Particularly, a care is taken to prevent air blows of the fans from entering the recording area to disturb the recording.

Figure 20:
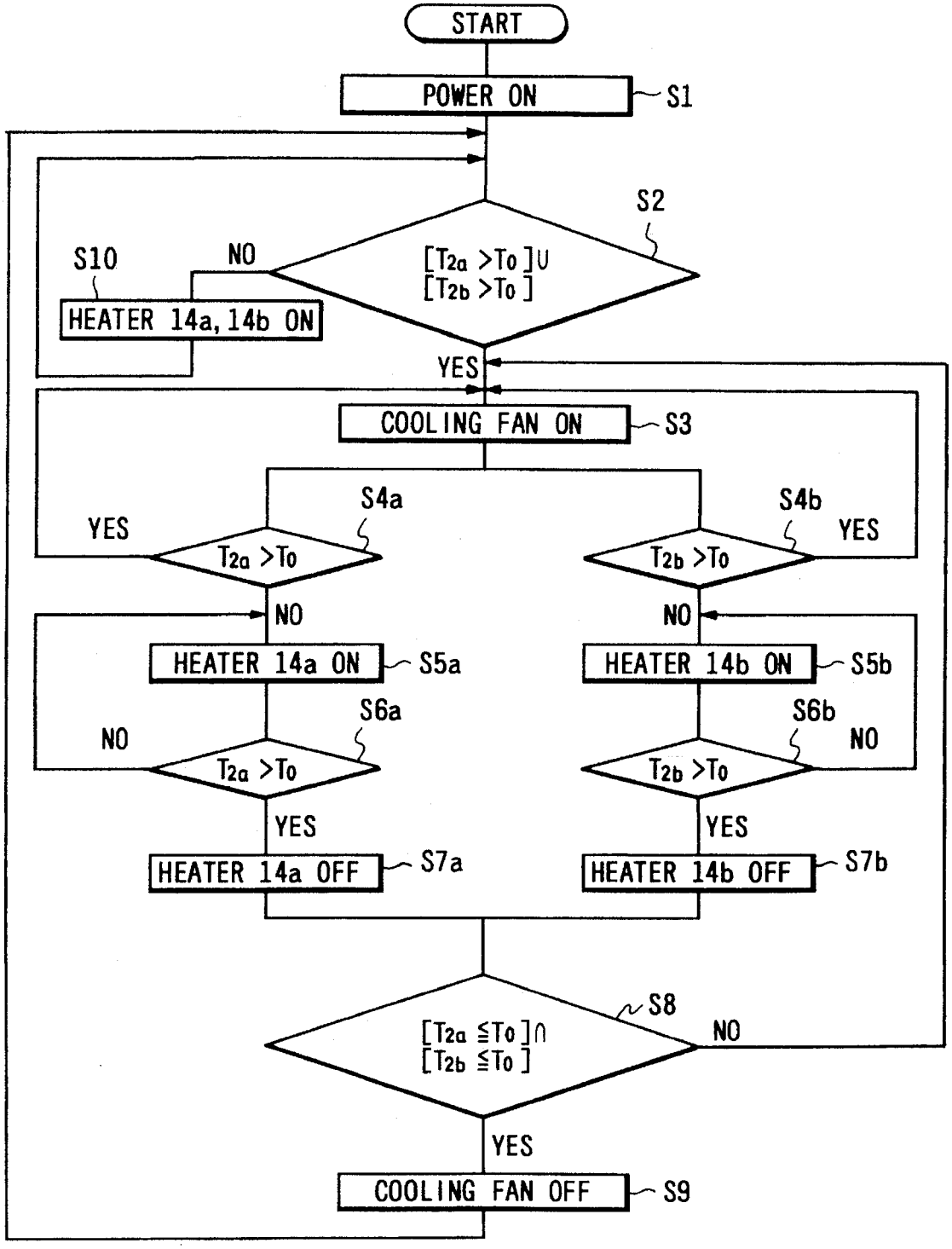
FIG. 20 is a flowchart showing the processing sequence of temperature control for a recording head.

FIG. 20 is a flowchart showing the processing sequence of ink temperature control effected in the embodiment of FIG. 19 by using the cooling fans 49*a*, 49*b* and the head heaters 14*a*, 14*b*.

When a power switch is turned on in step S1, it is determined in step S2 whether or not temperatures T2*a*, T2*b* detected by the temperature detecting means 15*a*, 15*b* in the recording heads 2*a*, 2*b* corresponding to the ink temperatures in the respective heads are higher than a setting temperature To. If the temperatures T2*a*, T2*b* detected in the recording heads 2*a*, 2*b* are both lower than the setting temperature To, the process goes to step S10 where the head heaters 14*a*, 14*b* provided in the recording heads 2*a*, 2*b* are driven to heat the ink in the heads.

As a result of the above decision, if the temperature detected by at least either one of the recording heads 2*a* and 2*b* is higher than the setting temperature To, the process goes to step S3 for driving the cooling fans 49*a*, 49*b*.

It is to be noted that while the recording heads 2*a*, 2*b* are associated with the head heaters 14*a*, 14*b* for heating the respective heads in this embodiment, the cooling fans 49*a*, 49*b* cannot separately be operated so as to blow air toward the fins 48*a*, 48*b* in an independent manner. Accordingly, even when the temperature detected by one of the recording heads is higher than the setting temperature To and the temperature detected by the other recording head is lower than the setting temperature To, both of the cooling fans 49*a*, 49*b* are operated.

Therefore, the recording heads 2*a*, 2*b* are separately controlled in steps S4*a*–S7*a* and steps S4*b*–S7*b* based on the temperatures detected in the recording heads 2*a*, 2*b*. More specifically, it is determined in step S4*a*, S4*b* whether or not the temperature T2*a*, T2*b* detected in the recording head 2*a*, 2*b* is higher than the setting temperature To. If the detected temperature is lower than the setting temperature To, the process goes to step S5*a*, S5*b* in parallel to energize the heater 14*a*, 14*b* until the temperature T2*a*, T2*b* detected in the recording heads becomes higher than the setting temperature To, through steps S5*a* and S6*a* or steps S5*b* and S6*b*.

Thus, when the temperature detected in either recording head is lower than the setting temperature, the heater associated with that recording head is energized so that the temperatures detected in both the recording heads are once increased higher than the setting temperature To. Afterward, the cooling fans 49*a*, 49*b* are driven to control the temperature detected in the recording head to approach the setting temperature To.

If the temperature T2*a*, T2*b* is determined higher than the setting temperature To in step S6*a*, S6*b*, the process goes to step S7*a*, S7*b* in parallel to stop energization of the heater 14*a*, 14*b*. During the process of steps S4*a*–S7*a* or steps S4*b*–S7*b*, the cooling fans 49*a*, 49*b* continue their operations to successively execute the process of lowering the head temperatures in the above control sequence. It should be understood that the control sequence may be designed to set a zone in which the heaters and the fans are both stopped at the same time, when the detected temperatures are within a predetermined range.

Next, step S8 determines whether or not the temperatures T2*a*, T2*b* detected in the recording heads 2*a*, 2*b* are both lower than the setting temperature To. If yes, the operation of the cooling fans 49*a*, 49*b* is stopped, followed by returning to step S2. If no, the process returns to step S3.

Figure 21:
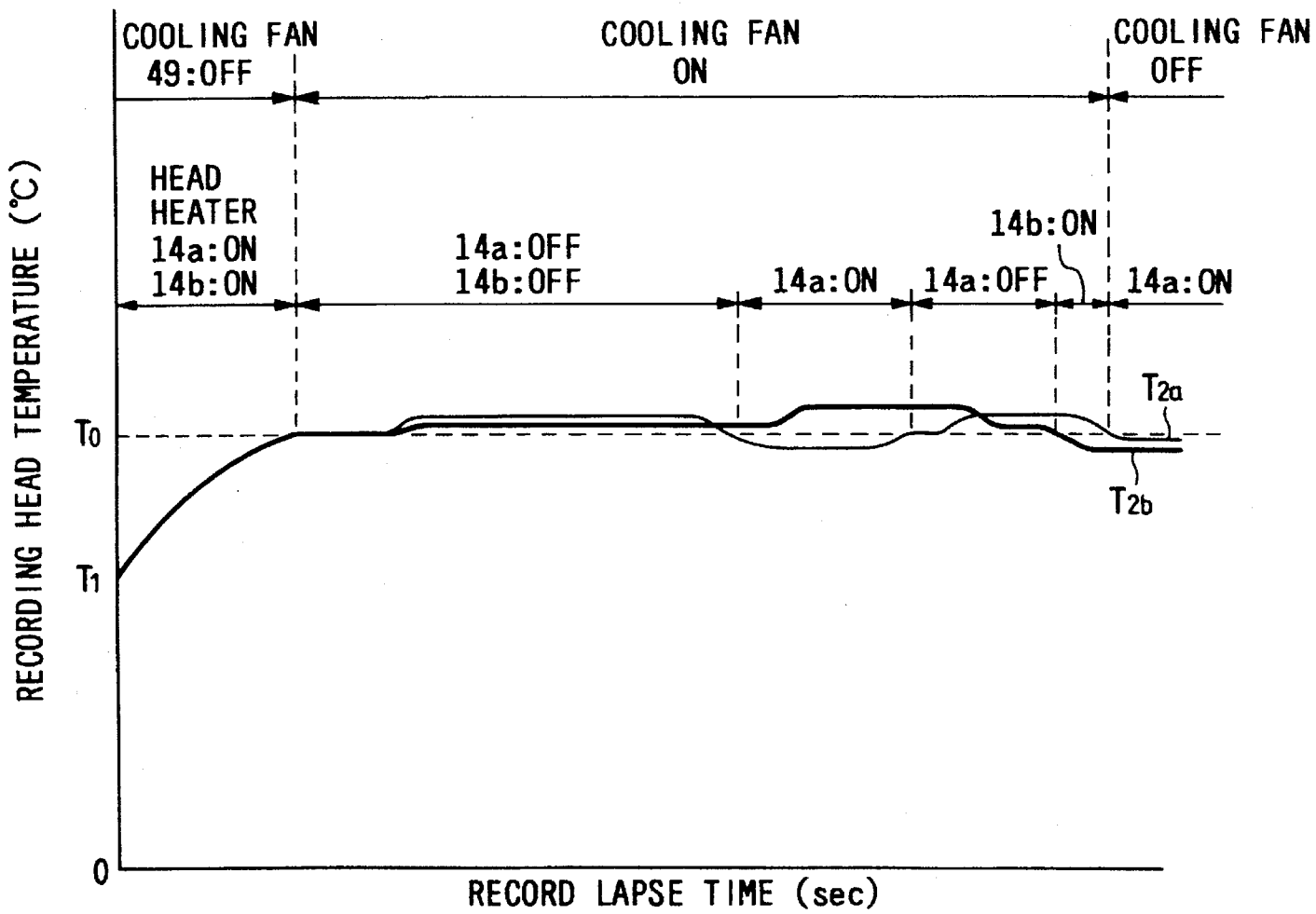
FIG. 21 is a characteristic graph showing temperature changes of a recording head with the record lapse time.

By repeating the above process during the recording operation, the temperatures detected in the recording heads are stabilized in the vicinity of the setting temperature To. FIG. 21 shows the result of the foregoing control sequence. In FIG. 21, a thin solid line represents the behavior of the temperature T2*a* detected in the recording head 2*a*, while a fat solid line represents the behavior of the temperature T2*b* detected in the recording head 2*b*. As will be seen from FIG. 21, the temperatures detected in the recording heads are stable near the setting temperature To, whereby the ink temperature in the nozzles 10 of each head is also held constant to prevent the recorded image from being degraded in its quality due to variations in the diameter of recorded dots. Note that such control can similarly be effected not only in the temperature adjustment for the serial type heads, but also in the temperature adjustment for the full-line type heads.

Although the above embodiment has been explained as driving the cooling fans 49*a*, 49*b* together simultaneously in the control sequence, the cooling fans 49*a*, 49*b* may separately be driven for control dependent on the temperatures of the recording heads 2*a*, 2*b*, respectively, such that when the recording head 2*a* has a higher temperature and the recording head 2*b* has a lower temperature, for example, only the cooling fan 49*a* is driven to cool the recording head 2*a* alone. This permits to further improve quality of the recorded image by preventing it from being degraded due to variations in the diameter of recorded dots between the recording heads.

Thus, the heaters and the cooling fans can properly be operated to maintain the temperature of the entire recording head at a uniform level, whereby the ink in the nozzles can be held at the prescribed temperature.

As a result, it becomes possible to obtain an ink jet recording apparatus in which image quality is not degraded or adversely affected by changes in temperature of the discharged ink and air flows produced by the fans.

As described above, the present invention is very effective in recording heads and recording apparatus of the bubble jet system, particularly, among various ink jet recording systems. The arrangement and principles of the bubble jet system are preferably based on the basic principles typically disclosed in U.S. Pat. No. 4,723,129 and U.S. Pat. No. 4,740,796 by way of example. The bubble jet system can be applied to any of the so-called on-demand and continuous types. In the case of the on-demand type system, at least one drive signal corresponding to recording information and imparting a rapid temperature rise enough to effect the so-called film boiling is applied to electro-thermal transducers (or thermal energy generator elements) arranged corresponding to sheets or liquid passages in which a liquid (ink) is retained. Thermal energy is thereby generated in the electro-thermal transducers to effect the film boiling at the heat acting surfaces of the recording head.

Consequently, the on-demand type system is especially effective in forming a vapor bubble inside the liquid (ink) in one-to-one relation to the drive signal. With growth and contraction of the bubble, the liquid (ink) is discharged through a discharge orifice to create at least one droplet thereof.

The drive signal is more preferably of a pulse signal because growth and contraction of the bubble can be progressed in a proper and prompt manner to achieve discharge of the liquid (ink) at very high responsity by using the pulse signal. The suitable pulse-like drive signal is disclosed in U.S. Pat. No. 4,463,359 and U.S. Pat. No. 4,345,262. In addition, more excellent recording can be made by adopting the conditions described in U.S. Pat. No. 4,313,124 which concerns with a rate of temperature rise at the aforesaid heat acting surface.

As to the arrangement of recording heads, other than the combined arrangement of discharge ports and electro-thermal transducers in liquid passages (i.e., linear or right-angled liquid flow passages) as mentioned in the foregoing disclosure, the present invention also includes such arrangement that the heat acting surface is arranged in a bent area, as disclosed in U.S. Pat. No. 4,558,333 and U.S. Pat. No. 4,459,600. The present invention is also equally effective in other arrangements that a slit common to a plurality of electro-thermal transducers is used as discharge portions of those electro-thermal transducers, as disclosed in Japanese Patent Laid-Open No. 59(1984)-123670, and that an orifice absorbing a pressure wave of thermal energy is formed in a discharge portion, as disclosed in Japanese Patent Laid-Open No. 59(1984)-138461.

In the case of the full-line type recording heads which have a length corresponding to a width of the maximum recording medium capable of being recorded by a recording apparatus, the total recording range can be covered by combining a plurality of recording heads, or employing a single recording head fabricated into the one-piece structure, as illustrated in the foregoing disclosure. In either case, the present invention can more effectively exhibit the advantageous effect mentioned above.

The present invention is further effective in recording heads of the chip type that can be changed in such a manner to automatically permit electric connection with an apparatus body and supply ink to the recording head from the apparatus body, when mounted on the apparatus body, and in recording heads of the cartridge type that an ink supply unit is provided integrally with the recording head unit itself. As the arrangement of a recording apparatus of the present invention, it is also preferable to additionally provide restoring means, auxiliary means for preliminary operation, and others on a recording head from the standpoint of achieving the advantageous effect of the present invention in a stabler manner. More specifically, it is effective for achievement of more stable recording that a recording head is provided with capping means, cleaning means, pressure or suction means, preliminary heating means by electro-thermal transducers or other heating elements or a combination thereof, as well as a preliminary discharge mode in which ink is discharged apart from actual recording. Moreover, a recording mode for the recording apparatus is not limited to a monochromatic recording mode using only a principal color such as black. The present invention is also very effective in a recording apparatus that includes at least one of a plural color mode using several different colors and a full-color mode producing any desired color by mixing of three principal colors, which may be effected by arranging a plurality of recording head into the one-piece structure or employing them in a combined manner.

What is claimed is:

1. An ink jet apparatus, comprising:

an ink jet head having a heat generating resistance element, said ink jet head discharging ink droplets by causing a change in a state of an ink by utilizing heat generated by said heat generating resistance element;

conveying means for conveying a recording medium to be recorded upon in a conveyance direction, so that a predetermined recording image is formed on said recording medium by ink droplets discharged by said ink jet head;

heat exchanging means for exchanging heat with said head, said heat exchanging means being attached to a side surface of said head where said element is provided;

heating means for heating said exchanging means, said heating means being a part of said heat exchanging means;

cooling means for cooling said heat exchanging means;

temperature detecting means for detecting a temperature of said heat exchanging means; and control means for controlling driving of said heating means and said cooling means based on the temperature detected by said temperature detecting means;

wherein said head to which said heat exchanging means is attached is joined to said apparatus so that said heat exchanging means is positioned at a downstream side in said conveyance direction of said recording medium.

2. An apparatus according to claim 1, wherein said temperature detecting means is covered by an insulative member having a heat conductive rate that is less than 1 W/m° K.

3. An ink jet recording apparatus, comprising:

an ink jet head having a heat generating resistance element, said ink jet head discharging ink droplets by causing a change in a state of an ink by utilizing heat generated by said heat generating resistance element, said head being constructed from a plurality of materials having different wetting characteristics;

conveying means for conveying a recording medium to be recorded upon in a conveyance direction, so that a predetermined recording image is formed on said recording medium by ink droplets discharged by said ink jet head; and heat exchanging means for exchanging heat with said head, said heat exchanging means being attached to a side surface of said head;

wherein said side surface to which said heat exchanging means is attached is a member having a high wetting characteristic, and said heat exchanging means is attached to said apparatus so that said heat exchanging means is positioned at a downstream portion in said conveyance direction of said recording medium.

4. An apparatus according to claim 3, wherein said heat exchanging means comprises heating means at a part thereof.

5. An apparatus according to claim 4, wherein said heat exchanging means further comprises a fin for promoting a discharge of heat therefrom at a part of said heat exchange means, and said apparatus further comprises blower means for blowing on said fin.

6. An apparatus according to claim 5, wherein said heat exchanging means further comprises temperature detecting means for detecting a temperature of said heat exchanging means at a part thereof, and said apparatus further comprises control means for controlling driving of said heating means and said blower means based on the temperature detected by said temperature detecting means.

7. An apparatus according to claim 3, wherein said heat generating resistance element is disposed upon a member having a higher wetting characteristic.

* * * * *

UNITED STATES PATENT AND TRADEMARK OFFICE

CERTIFICATE OF CORRECTION

PATENT NO. : 5,512,924

DATED : April 30, 1996

INVENTOR(S) : YOSHIHIRO TAKADA ET AL.

It is certified that error appears in the above-identified patent and that said Letters Patent is hereby corrected as shown below:

On the Title page, item [54], and Col. 1, line 1;
In the Title:

"JET APPARATUS" should read --INK JET APPARATUS--.

COLUMN 1

Line 1, "JET APPARATUS" should read --INK JET APPARATUS--.
Line 66, "10" should be deleted.

COLUMN 3

Line 49, "certain" should read --a certain--.

COLUMN 4

Line 38, "concept" should read --the concept--.
Line 39, "different" should read --is different--.

COLUMN 5

Line 10, "means-and/or" should read --means and/or--.

COLUMN 6

Line 30, "and" should be deleted.
Line 34, "unit;" should read --unit; and--.
Line 35, "showing" should read --show a--.

UNITED STATES PATENT AND TRADEMARK OFFICE

CERTIFICATE OF CORRECTION

PATENT NO. : 5,512,924

DATED : April 30, 1996

INVENTOR(S) : YOSHIHIRO TAKADA ET AL.

It is certified that error appears in the above-identified patent and that said Letters Patent is hereby corrected as shown below:

COLUMN 7

Line 54, "heat 112" should read --head 112--.
Line 56, "above mentioned" should read --above-mentioned--.
Line 64, "mounting" should read --of mounting--.

COLUMN 8

Line 1, "or" should read --on--.
Line 18, "103" should be deleted.
Line 42, "direction B" should read --direction $\beta$--.

COLUMN 9

Line 19, "Meanwhile," should read --¶ Meanwhile,--.
Line 22, "The" should read --¶ The--.
Line 26, "viewpoint" should read --the viewpoint of--.
Line 62, "holds" should read --holds at--.

COLUMN 10

Line 17, "b." should read --$\beta$.--.

COLUMN 13

Line 3, "an" should read --a--.
Line 7, "so does" should read --as does--.

UNITED STATES PATENT AND TRADEMARK OFFICE

CERTIFICATE OF CORRECTION

PATENT NO. : 5,512,924

DATED : April 30, 1996

INVENTOR(S) : YOSHIHIRO TAKADA ET AL.

It is certified that error appears in the above-identified patent and that said Letters Patent is hereby corrected as shown below:

COLUMN 14

Line 4, "an" should read --a--.
Line 22, "that" should read --those--.
Line 35, "head" should read --head is--.
Line 49, "$+66T_{MAX}$" should read --$+\Delta T_{MAX}$--.

COLUMN 15

Line 11, "As" should read --As is--.
Line 24, "can be resulted" should read --can result--.
Line 49, "materail" should read --material--.
Line 51, "extended-portion" should read --extended portion--.

COLUMN 16

Line 18, "a not-shown" should read --an unshown--.
Line 25, "parallel-piped)" should read --parallelepiped)--.

COLUMN 18

Line 40, "recording" should read --the recording--.

COLUMN 20

Line 50, "by" should read --be--.
Line 54, "made" should read --is made--.

UNITED STATES PATENT AND TRADEMARK OFFICE

CERTIFICATE OF CORRECTION

PATENT NO. : 5,512,924

DATED : April 30, 1996

INVENTOR(S) : YOSHIHIRO TAKADA ET AL.

It is certified that error appears in the above-identified patent and that said Letters Patent is hereby corrected as shown below:

COLUMN 23

Line 18, "fat" should read --thick--.

COLUMN 24

Line 13, "with" should be deleted.
Line 65, "head" should read --heads--.

Signed and Sealed this

First Day of October, 1996

Bruce Lehman

BRUCE LEHMAN

*Commissioner of Patents and Trademarks*

*Attest:*

*Attesting Officer*